US011545317B2

(12) United States Patent
Guy et al.

(10) Patent No.: US 11,545,317 B2
(45) Date of Patent: Jan. 3, 2023

(54) FOLDED KEY STABILIZER

(71) Applicant: Apple Inc., Cupertino, CA (US)

(72) Inventors: Ian A. Guy, Cupertino, CA (US); Ari P. Miller, San Francisco, CA (US); Edward J. Cooper, Campbell, CA (US); Houtan R. Farahani, San Ramon, CA (US); Kevin M. Robinson, Sunnyvale, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 17/651,972

(22) Filed: Feb. 22, 2022

(65) Prior Publication Data

US 2022/0181102 A1 Jun. 9, 2022

Related U.S. Application Data

(63) Continuation of application No. 16/536,091, filed on Aug. 8, 2019, now Pat. No. 11,282,656.

(60) Provisional application No. 62/783,866, filed on Dec. 21, 2018.

(51) Int. Cl.

| | |
|---|---|
| ***H01H 3/12*** | (2006.01) |
| ***H01H 13/14*** | (2006.01) |
| ***H01H 13/7065*** | (2006.01) |

(52) U.S. Cl.

CPC ..... *H01H 13/14* (2013.01); *H01H 3/125* (2013.01); *H01H 13/7065* (2013.01); *H01H 2221/036* (2013.01); *H01H 2221/058* (2013.01)

(58) Field of Classification Search

None

See application file for complete search history.

(56) References Cited

U.S. PATENT DOCUMENTS

| | | | |
|---|---|---|---|
| 6,864,449 | B2 | 3/2005 | Ito |
| 10,275,040 | B2 | 4/2019 | Goldberg et al. |
| 10,431,404 | B1 | 10/2019 | Lin |
| 2020/0201399 | A1 | 6/2020 | Guy et al. |

*Primary Examiner* — Felix O Figueroa

(74) *Attorney, Agent, or Firm* — Dorsey & Whitney LLP

(57) ABSTRACT

Key assemblies having a foldable stabilizer are disclosed. The stabilizer can be positioned under a keycap to help guide the keycap and limit rotation or movement when the key is pressed. The stabilizer can have a pointed-star shape with multiple folding axes and can have multiple points of connection or linkage to the keycap or other surrounding components. The stabilizer can unfold or flatten as the keycap is pressed and can fold as the keycap is raised.

20 Claims, 13 Drawing Sheets

FOLDED KEY STABILIZER

CROSS-REFERENCE TO RELATED APPLICATIONS

This is a continuation of, and claims priority to, U.S. patent application Ser. No. 16/536,091, filed 8 Aug. 2019 and entitled "FOLDED KEY STABILIZER," which claims priority to U.S. Provisional Patent Application No. 62/783,866, filed 21 Dec. 2018 and entitled "FOLDED KEY STABILIZER," the entire disclosures of which are hereby incorporated by reference.

FIELD

The described embodiments relate generally to key mechanisms for keyboards. More particularly, the present embodiments relate to folding key structures enabling parallel motion of keys in a keyboard.

BACKGROUND

Many electronic devices have interface devices and mechanisms to receive input and interaction from users. Major fields for device interaction include computers, such as personal computers, tablet computers, smartphones, and other "smart" devices, such as media players, video and audio equipment, vehicle consoles, home automation controllers, and related devices. These devices can include keyboards, keypads, buttons, touchpads, and other input and interaction devices to receive user input. In some cases, the input and interaction devices can also provide output and feedback to users as well, such as through visual, touch/haptics, or audio indicators.

Keyboards and other interface devices are designed with buttons or keys that are pressed by users to generate input signals for a processor or controller. These devices are often designed to provide a controlled amount of resistance to the user's fingertips in order to give tactile feedback as the user presses a button or key. The feel, sound, cost, and size of each button or key are tightly controlled to provide a desired user experience. Although some keyboards are "virtual," such as software keyboards displayed on a touchscreen device, it can be beneficial to provide key travel, or movement of the keys, to help the user more easily feel, see, and hear when and where a key is pressed and to provide an overall more satisfying interaction with the device.

Providing this type of key or button can come with costs. Many interface devices have a high number of very small moving parts per button or per key, so the mechanisms can be undesirably complex, expensive, and have many possible points of failure. Thus, there are many challenges and areas for improvements in interface devices, and device makers are constantly seeking ways to enhance a user's experience.

SUMMARY

One aspect of the present disclosure relates to a key mechanism. The key mechanism can comprise a keycap, a base layer positioned below the keycap, and a stabilizer coupled to the keycap and to the base layer. The stabilizer can include rigid panels arranged in a pointed-star pattern and hinge portions coupling the rigid panels to each other. The rigid panels can be rotatable or movable relative to each other about the hinge portions in response to movement of the keycap relative to the base layer.

In some embodiments, the rigid panels can be triangular. The hinge portions can be elastically expandable, wherein a distance between edges of the rigid panels can be variable upon elastic expansion of the hinge portions. The pointed-star pattern can comprise a set of at least two pointed portions. The stabilizer can also be bistable.

In some configurations, the key mechanism can further comprise a collapsible dome positioned between the stabilizer and the base layer. The ratio of vertical keycap movement relative to the base layer versus vertical dome movement relative to the base layer can be greater than or less than 1:1. The stabilizer can be coupled to the keycap using a bendable link, with the bendable link being elongated in a direction perpendicular to a direction of motion of the keycap relative to the base layer. The stabilizer can be coupled to the keycap using a soft mount spanning a distance between an underside of the keycap and a top surface of the stabilizer, wherein the distance can be variable upon movement of the keycap relative to the base layer. The stabilizer can be coupled to the keycap using an end-constrained sliding mounting.

In some embodiments, the key mechanism can further comprise a first structure positioned on the stabilizer and a second structure positioned on the keycap, with the first structure being magnetically attracted to the second structure and biasing the stabilizer toward the keycap. An outer portion of the pointed-star pattern can be mounted to the keycap and an inner portion of the pointed-star can be is mounted to the base layer, with the inner portion being positioned radially inward relative to the outer portion. Alternatively, an outer portion of the pointed-star pattern can be mounted to the base layer and an inner portion of the pointed-star pattern can be mounted to the keycap, with the inner portion being positioned radially inward relative to the outer portion.

Another aspect of the disclosure relates to a keyboard comprising a set of keycaps, a feature plate positioned under the keycaps, and a set of foldable structures positioned under the keycaps. A foldable structure of the set of foldable structures can comprise at least two intersecting folding axes and can be movable between a raised position and a collapsed position in response to movement of a keycap of the set of keycaps. The foldable structure can be configured to bend along the at least two intersecting folding axes while moving between the raised position and the collapsed position.

In another case, the foldable structure of the set of foldable structures can be configured to unfold along the at least two intersecting folding axes while moving from the raised position to the collapsed position. The at least two intersecting folding axes can comprise a first axis and a second axis, with the foldable structure of the set of foldable structures forming an upward-pointing ridge at the first axis and forming a downward-pointing ridge at the second axis. The set of foldable structures can be interconnected to each other across a layer of material.

The foldable structure can comprise a sheet of material with a reduced thickness along one of the at least two intersecting folding axes. Additionally, the foldable structure can be biased to the raised position by material positioned along the at least two intersecting folding axes. The at least two folding axes can intersect outer points of the foldable structure, with the outer points being configured to translate relative to a center point of the foldable structure upon movement of the foldable structure between the raised position and the collapsed position.

Yet another aspect of the disclosure relates to a method of manufacturing a key stabilizer. The method can comprise positioning a sheet of resilient material in a planar orientation, increasing the stiffness of portions of the sheet of resilient material, wherein at least two axes are positioned between the stiffened portions of the sheet of resilient material, bending the resilient material along the at least two axes between the stiffened portions of the sheet of resilient material to form a three-dimensional star shape, and positioning at least the stiffened portions between a keycap and a base layer, wherein movement of the keycap relative to the base layer induces folding or unfolding of the three-dimensional star shape.

This method may further include applying tension to the sheet of resilient material before increasing the stiffness of the portions of the sheet, wherein the three-dimensional star shape is biased into a folded configuration by the sheet of resilient material along the at least two axes after releasing the tension.

Increasing the stiffness of portions of the sheet of resilient material can comprise applying a rigid material to the resilient material in the stiffened portions. Increasing the stiffness of portions of the sheet of resilient material can also comprise increasing a thickness of the sheet of resilient material in the stiffened portions relative to a thickness of the sheet of resilient material along the at least two axes. In some embodiments, multiple three-dimensional star shapes are formed on the sheet of resilient material.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
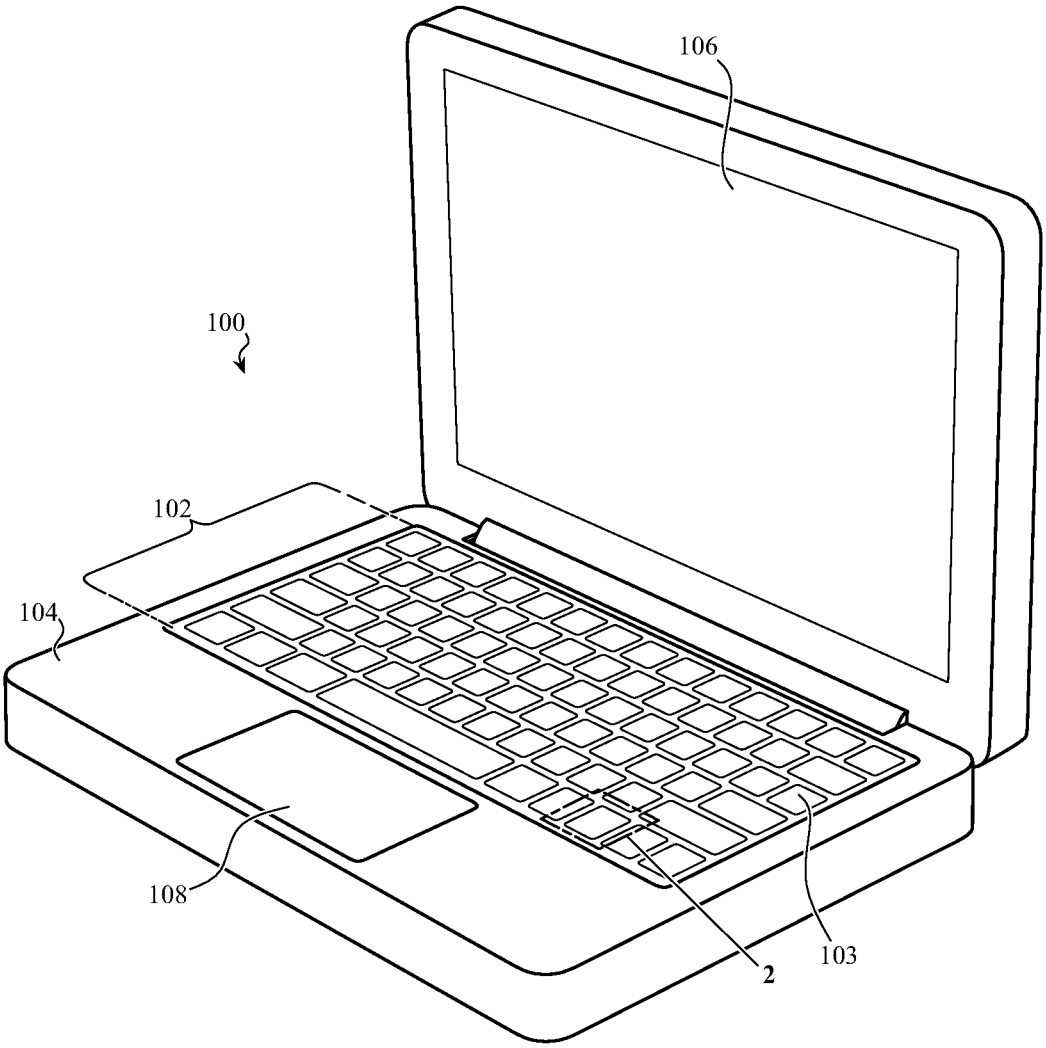
FIG. 1 shows an isometric view of an electronic device according to the present disclosure.

The present description provides examples, and is not limiting of the scope, applicability, or configuration set forth in the claims. Thus, it will be understood that changes can be made in the function and arrangement of elements discussed without departing from the spirit and scope of the disclosure, and various embodiments can omit, substitute, or add other procedures or components as appropriate. For instance, methods described can be performed in an order different from that described, and various steps can be added, omitted, or combined. Also, features described with respect to some embodiments can be combined in other embodiments.

Interface devices such as computer keyboards and buttons in smartphones, tablets, and other interactive devices are often required to provide a desired amount and type of deflection, force-resistance, tactility, and noise. These factors can contribute to the user's satisfaction in using the device and their perceived quality of the device and its construction. The cost and methods used to construct and provide these interface devices can also be significant factors in their design and implementation.

A large number of parts can be required to produce the desired user experience for each key or button. In a keyboard key, for example, the parts can include a dome switch, a switch housing, a butterfly or scissor mechanism, a keycap, a lighting element, a substrate, and other component parts. These parts are usually small and delicate in order to minimize the overall depth of the keyboard, but they are often also required to be durable enough to endure millions of use cycles. Using a high number of parts greatly increases the cost of the device, at least in part, because in order to provide a consistent feel across a keyboard or set of buttons, each part is individually replicated for each key or button. For example, each key typically has its own switch housing, butterfly mechanism, light diffuser, etc. In some cases, each part is individually assembled into the keyboard, thereby increasing manufacturing time, complexity, and related costs, even if it is done robotically. A keyboard with 70 keys may require over 400 delicate parts that are constructed and then precisely assembled.

Device makers often desire to implement keys or buttons that have parallel surface motion (i.e., horizontally stabilized key travel). When the key is pressed, the top surface can be configured to remain substantially entirely horizontal (e.g., perpendicular to the direction of travel) throughout the key's travel cycle. In other words, the top surface of the key translates in a direction perpendicular to the top surface rather than tilting or rotating during travel. This motion can be challenging to achieve, particularly when the outer edge of a key is pressed and there is a spring or flexible dome biasing the center of the key against downward translation at the same rate as the edge of the key. However, minimizing surface tilting, even when the edge of a button is pressed, can help provide consistent feel and resistance for off-center key presses, thereby improving the overall user experience.

Aspects of the present disclosure can improve interface devices and their construction by providing lower costs in materials and manufacturing and fewer failure modes while also providing a desired amount of key travel, parallel motion, and key definition. Key stabilizers can be constructed without traditional pivoting wings or limbs and can instead comprise a foldable and unfoldable sheet or other structure configured to flatten when a keycap is pressed and to fold such that it increases in height when the keycap is released. The key stabilizers can be referred to as "origami" stabilizers due to their folding characteristics and generally contiguous parts. They can also be formed in an interconnected sheet, wherein multiple key stabilizers are formed in an integral and continuous sheet of material, similar to multiple folds in a sheet of paper.

In some embodiments, the stabilizers include a set of rigid (or at least substantially rigid) triangular panels and a set of hinges coupling the edges of the rigid panels to each other in a substantially star-shaped, three-dimensional pattern. One of the key stabilizers can stabilize the vertical movement of a keycap when the keycap is pressed off-center by a user. The off-center pressure that tends to flatten one part of the star-shaped pattern can cause the other parts of the star-shaped pattern to flatten at the same time. In other words, flattening deformation of one part of the star-shaped pattern can induce simultaneous flattening deformation of the other parts of the star-shaped pattern. If one section of the star-shaped pattern is connected to the keycap and that section is moved downward, the other sections of the star-shaped pattern that are also connected to the keycap can be configured to move downward at the same time. Accordingly, even though pressure on the keycap is applied offset from its axis of motion, the keycap can tend to stay in a substantially horizontal orientation as it moves vertically due to each section of the star-shaped pattern moving the keycap downward all around the axis of motion from below. As used herein, a "substantially horizontal orientation" refers to an orientation substantially perpendicular to the direction of movement of the structure within a few degrees of rotation or with zero degrees of rotation about an axis perpendicular to the direction of movement.

Hinges connecting the rigid panels in a stabilizer can comprise an elastically resilient material, wherein in some cases the hinges can stretch when the star-shaped stabilizer is flattened. For example, an elastomeric sheet of material can be used to create the hinges. In some embodiments, the material can comprise a rubber, an elastic polymer, an elastic fabric or textile, a similar material, or combinations thereof. The stretched hinges can then tend to bias the stabilizer into the un-depressed or neutral position. As a result, the keycap can be biased into its neutral configuration by the stabilizer. In other embodiments, the stabilizer can flatten and then invert when pressed. The stabilizer can therefore be bistable in a manner similar to a compressible or collapsible resilient dome used in a conventional membrane keyboard.

In some cases, the hinges connecting the rigid panels are not elastically resilient. For example, a non-stretching but bendable sheet of material or a series of mechanical hinge linkages can be used to create the hinges. This material can be substantially inelastic when in tension, such as a fiber-based composite, bendable fabric or textile, elastically bendable and thin metal, similar materials, or combinations thereof. Mechanical linear hinges (e.g., door hinges) can also be implemented. When bending these configurations, the distances between the rigid panels can be substantially constant as the relatively rigid panels move. In these embodiments, the stabilizer does not necessarily bias the keycap, and the range of motion of the hinges can prevent the stabilizer from inverting or otherwise having more than one stable position.

The stabilizer can be connected to a keycap using various types of linkages, including, for example, a pin-in-slot mounting, buckling or bending beams of material attached to the keycap and stabilizer, or a soft mount (e.g., slides contacting the top surface of the stabilizer). Movement of the keycap can thereby be transferred to the stabilizer via the linkages in place of, or in addition to, direct contact between the bottom surface of the keycap and the top surface of the stabilizer underlying the keycap. Additionally, vertical movement of the keycap can be proportional or disproportional to the vertical movement of the top of the stabilizer.

A folding stabilizer can have a variety of different shape configurations, such as, for example, a two-pointed star, a three-pointed star, a four-pointed star, a five-pointed star, or a star having more points. The outer tips of the pointed sections of the star shapes can expand radially outward as the stabilizer flattens or collapses, or the outer tips can be rigidly pinned or fixed in place. Crook points between the tips of the pointed sections can likewise be configured to expand radially outward as the stabilizer flattens or collapses. In some embodiments, the star patterns can comprise at least two centrally-intersecting folding axes. As the stabilizer moves, it can bend along the at least two intersecting folding axes. In some embodiments, the stabilizer can fold at one of the folding axes and can unfold at another folding axis.

The rigid panels can be attached to or formed from a fabric, textile, or other flexible layer of planar material. For instance, rigid panels can be attached or formed using a printing process (e.g., a 3D printing process) or other process used to deposit or harden material to the flexible layer of material. Accordingly, the flexible layer of material can be selectively stiffened and rigidized to create the rigid panels.

In some embodiments, the flexible layer can be tensioned when the rigid panels are applied or printed on the flexible layer. Afterward, tension can be released and the hinges can be pre-tensioned and thereby bias the rigid portions into a predetermined raised configuration. In other cases, a layer of rigid material can selectively be made flexible where needed to create hinges between rigid portions of the layer of rigid material. For example, lines between sections of the rigid material can be weakened (e.g., thinned, perforated, or compressed) to make the material less rigid and more flexible along those lines. Using these methods, multiple stabilizers can be formed on a single sheet of flexible or rigid material. The stabilizers can be separated from each other and used separately in a keyboard, or they can remain in a single sheet positioned in a keyboard. Thus, the stabilizers can be interlinked around their outer perimeters or along strips of connecting material connecting their outer perimeters to each other. In some cases, the rigid panels can be a set of distinct parts and pieces that are assembled and attached to each other by hinges (e.g., door hinges or applied flexible material links).

In some embodiments, a key mechanism is set forth having a keycap, a base layer (e.g., a feature plate or circuit board) under the keycap, and a stabilizer coupled to the keycap and to the base layer. A compressible dome can be included beneath the stabilizer to help bias the keycap and stabilizer. In addition, the compressible dome can be used as part of a switch triggered by movement of the keycap and/or stabilizer. Thus, the folding key support can be part of a key mechanism used with a switch or as part of a switch.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

FIG. 1 depicts an electronic device 100 including a keyboard 102. The keyboard 102 includes key mechanisms or assemblies with keycaps 103 or button caps that move when depressed by a user. The keyboard 102 can be positioned in a lower portion (i.e., a "base" portion) of a housing 104. An upper portion (i.e., a "lid" portion) of the housing 104 of the electronic device 100 can include a display 106 (e.g., a liquid crystal display screen). The lower portion of the housing 104 can also include a track pad 108 used to provide input to the electronic device. The upper and lower portions can be connected to each other by a hinge.

Although the electronic device 100 of FIG. 1 is a notebook/laptop computer, it will be readily apparent that features and aspects of the present disclosure that are described in connection with the notebook computer can be applied in various other devices. These other devices can include, but are not limited to, personal computers (including, for example, computer "towers," "all-in-one" computers, computer workstations, and related devices) and related accessories, speakers, graphics tablets and graphical input pens/styluses, watches, headsets, other wearable devices, and related accessories, vehicles and related accessories, network equipment, servers, screens, displays, and monitors, photography and videography equipment and related accessories, printers, scanners, media player devices and related accessories, remotes, headphones, earphones, device chargers, computer mice, trackballs, and touchpads, point-of-sale equipment, cases, mounts, and stands for electronic devices, controllers for games, remote control (RC) vehicles/drones, augmented reality (AR) devices, virtual reality (VR) devices, home automation equipment, and any other electronic device that uses, sends, or receives human input. Thus, the present disclosure provides illustrative and non-limiting examples of the kinds of devices that can implement and apply aspects of the present disclosure.

Figure 2:
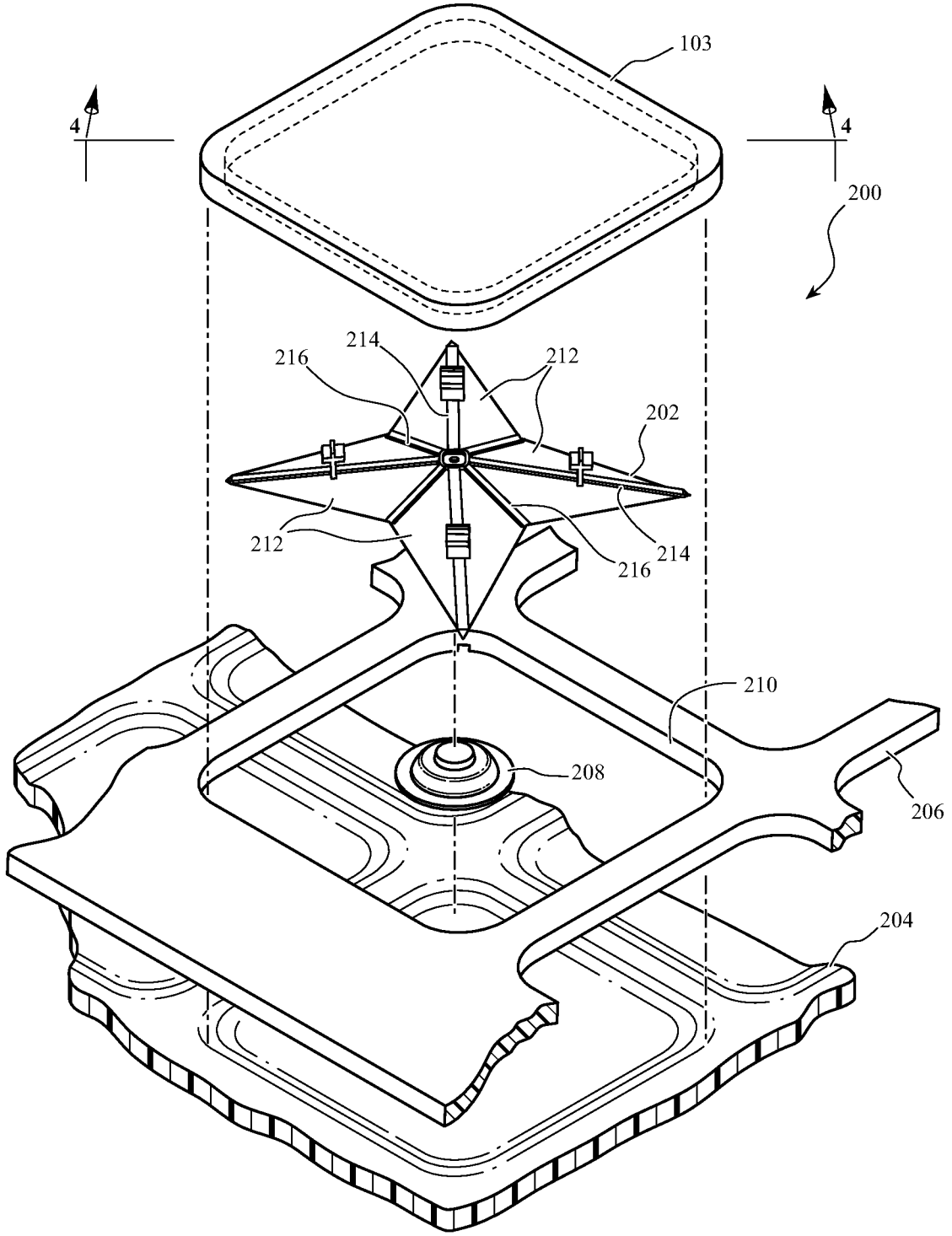
FIG. 2 is an isometric exploded view of a portion of the electronic device of FIG. 1 taken from box 2 in FIG. 1.
Figure 4:
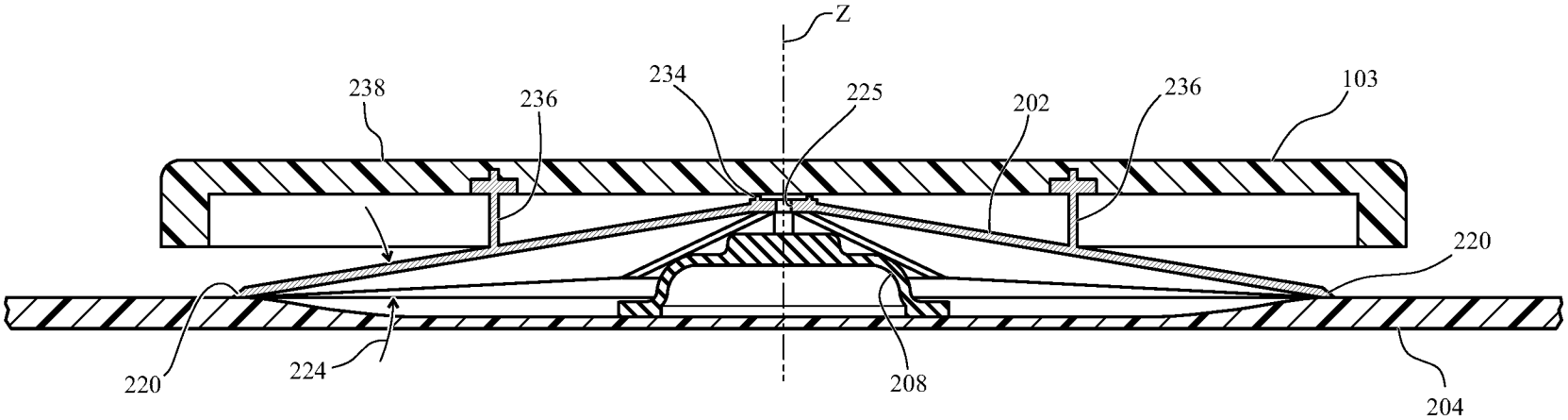
FIG. 4 is a side section view of the key assembly of FIG. 2 taken through section lines 3-3 in FIG. 2.
Figure 5:
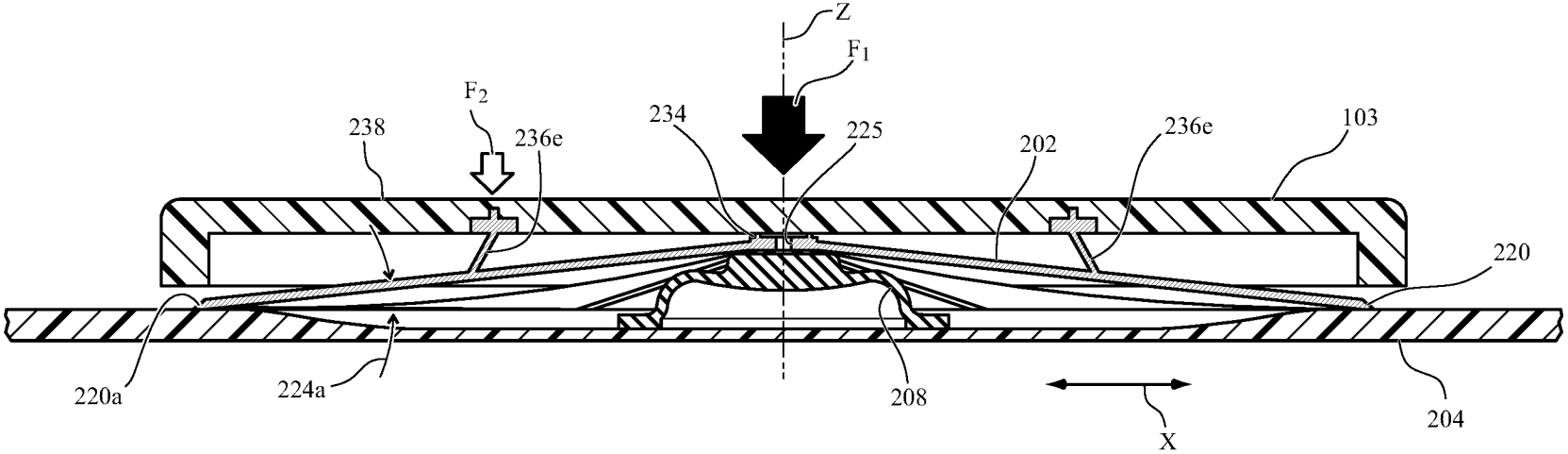
FIG. 5 is a side section view of the key assembly of FIG. 4 in a depressed condition.

The keyboard 102 can include a set of assembled components for each key. The assembly of these components can be referred to as a "stack-up" due to their substantially layered configuration. FIG. 2 illustrates a partial exploded view of an assembly 200 corresponding to one of the keys in keyboard 102, as indicated by box 2 in FIG. 1. One or more assemblies 200 can be implemented in the keyboard 102, such as one for each keycap 103 or button. Some of the parts of the assembly 200 can span multiple keys or can extend beyond the limits shown in FIG. 2 in one or more directions, as indicated by jagged edge lines. For example, as explained herein, the base layer 204 and web 206 can extend across the width of the whole keyboard 102. FIGS. 4-5 show simplified section views of the keyboard assembly 200 in an assembled condition, as indicated by section line 4-4 in FIG. 2.

Referring again to FIG. 2, an exploded isometric view of the keyboard assembly 200 is shown. The assembly 200 can comprise a keycap 103, a stabilizer 202, a base layer 204, a web 206, and a collapsible dome 208. Thus, the assembly 200 can comprise a set of layered components, wherein the keycap 103 is positioned above the stabilizer 202 which is above the collapsible dome 208, and the collapsible dome 208 is above the base layer 204. The web 206 can laterally surround one or more of the layered components due to the layered components being positioned within an opening 210 in the web 206.

The keycap 103 can provide a surface against which the user can interface with the keyboard assembly 200. Thus, the keycap 103 can be movable between an unactuated state at a first vertical position relative to the base layer 204 and an actuated state at a second vertical position relative to the base layer 204. Generally, the second vertical position is closer to the base layer 204 than the first vertical position.

The keycap 103 can comprise a rigid material such as a hard plastic, metal, or ceramic material. In an example embodiment, the keycap 103 includes a glass or polymer. The keycap 103 can also include a glyph or symbol (not shown) visible to the user. In some cases, the keycap 103 can be at least partially transparent or translucent, thus allowing light to be transferred through the keycap 103. The light can be directed through or around a glyph or symbol of the keycap 103 in order to improve its readability. In some embodiments, light is directed through or around an outer perimeter of the keycap 103. In various cases, the keycap 103 can have a flat top surface or a concave spherical or cylindrical "scooped" top surface. In some embodiments, the keycap 103 can be connected to other surrounding keycaps by a layer of flexible material positioned either above or below the keycaps.

The base layer 204 can be a housing or other rigid base structure of the keyboard assembly 200. The base layer 204 can also comprise a substrate such as, for example, a printed circuit board (PCB) having conductive traces and other electrical components. In some embodiments, a light source (not shown) can be positioned on the base layer 204 and light from the light source can be directed up into or around the keycap 103. In some embodiments, the base layer 204 can include brackets or other retention features to retain the stabilizer 202 to the base layer 204. The base layer 204 can also be made with a translucent or transparent material to permit light from a light source below the base layer 204 to be transferred upward to the keycap 103.

Figure 3:
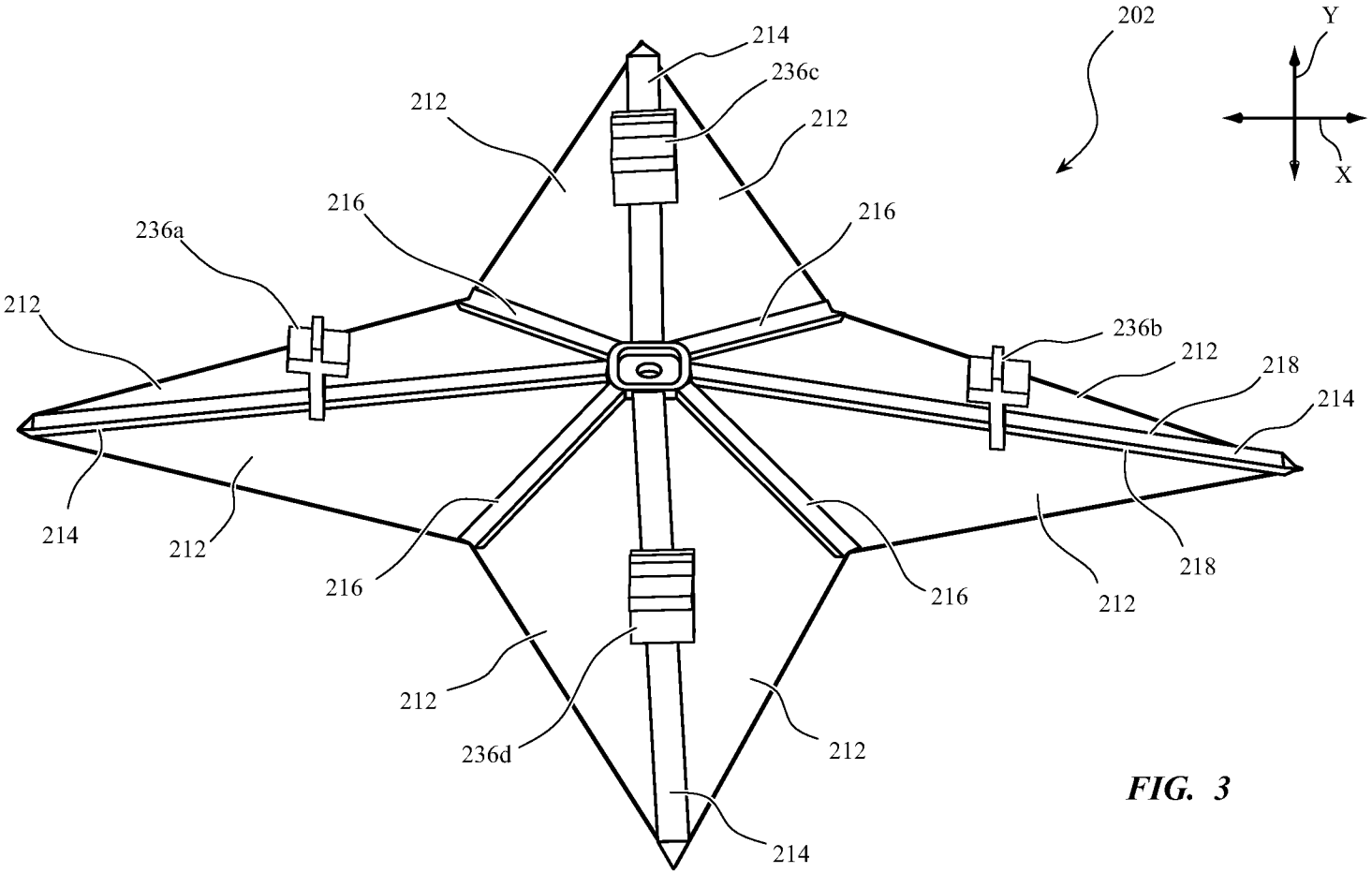
FIG. 3 is an isometric view of a stabilizer of a key assembly of the electronic device of FIG. 1.

Referring now to FIGS. 2 and 3, the stabilizer 202 can comprise a pointed star shape. The pointed star shape can include multiple triangular panels 212 connected to each other by upper linear hinges 214 and lower linear hinges 216. As used herein, a "linear hinge" is defined as a hinge pivotable about a single axis of rotation and that has an elongated length along that axis. The triangular panels 212 have edges (e.g., 218) extending along the elongated lengths of the hinges. See FIG. 3. The triangular panels 212 adjacent to an upper linear hinge 214 form a vertically-upward-pointing ridge (i.e., with an inverted "V"-shaped side cross-section) along the upper linear hinge 214 when the stabilizer 202 is in a raised condition. The triangular panels 212 adjacent to a lower linear hinge 216 form a vertically-downward-pointing ridge (i.e., a "V"-shaped side cross-section) along the lower linear hinge 216 when the stabilizer is in a raised condition. All of the linear hinges 214, 216 can extend along axes that centrally intersect at the middle of the stabilizer 202, as explained in further detail below.

FIG. 4 shows a section view of the keyboard assembly 200 in a raised condition. This raised condition can correspond to a relatively undepressed or neutral position for the keycap 103. As shown in FIG. 5, application of a force $F_1$ to the keycap 103 can cause the keycap 103 to move downward (i.e., toward the base layer 204), and the vertical heights (e.g., as measured along the axis of motion Z of the keycap 103) of the stabilizer 202 and the dome 208 are reduced in response to the pressure applied by the keycap 103. The change in the shape of the stabilizer 202 can be referred to as an unfolding or flattening of the stabilizer, and the change in the shape of the dome 208 can be referred to as a collapsing or compression of the dome 208. Accordingly, the state of the key assembly 200 shown in FIG. 5 can be referred to as an unfolded, collapsed, depressed, actuated, or compressed condition. As the stabilizer 202 moves from the raised condition (in FIG. 4) to the unfolded condition (in FIG. 5), the triangular panels 212 unfold about the upper linear hinges 214 and the lower linear hinges 216 and collectively flatten into a more planar configuration. The flattening allows the keycap 103 to move due to the decrease in the height of the stabilizer 202.

Figure 6:
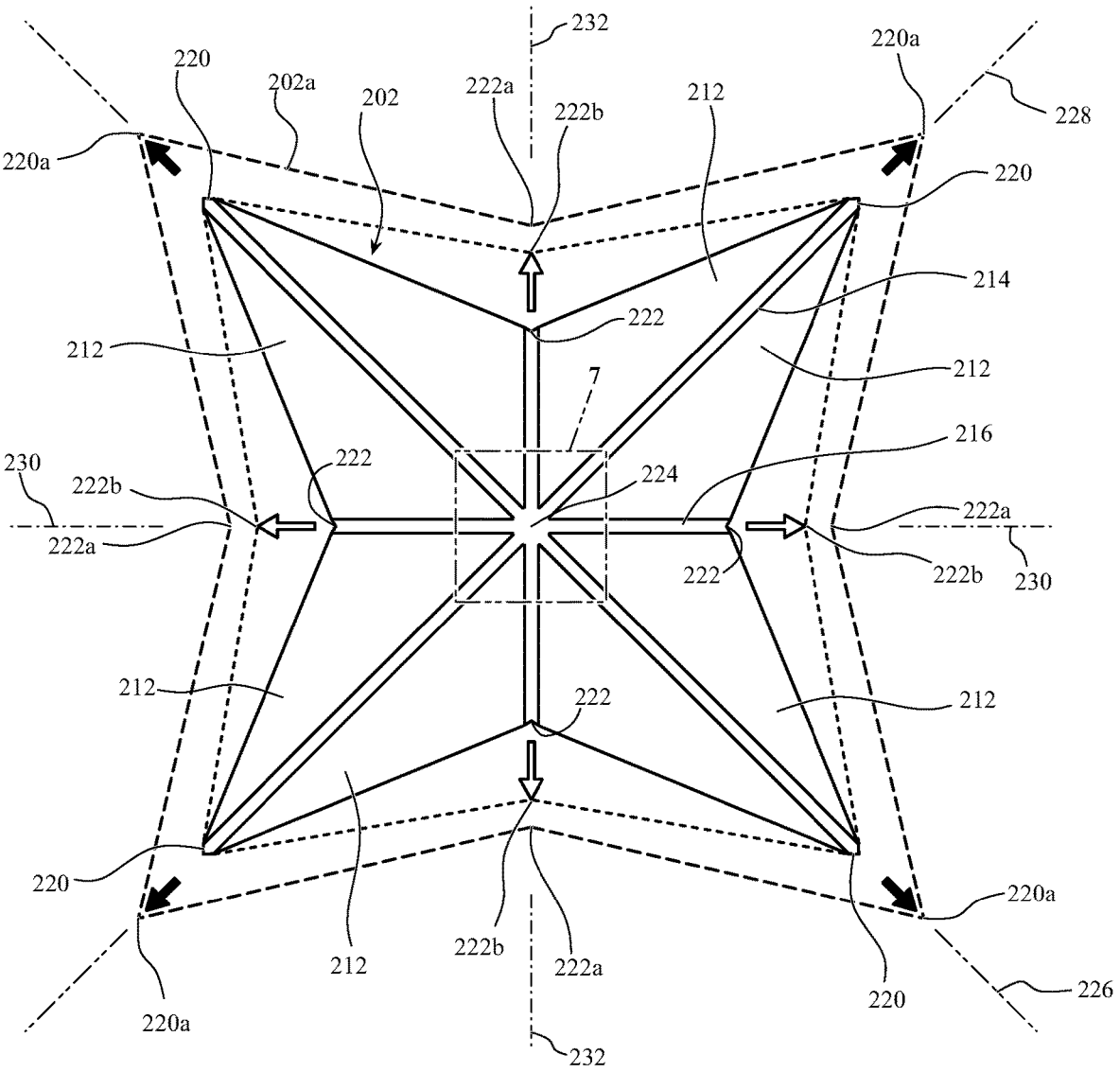
FIG. 6 is an isolated top view of a stabilizer of a key assembly of the electronic device of FIG. 1.

FIG. 6 is a top view of a stabilizer 202 with other surrounding components (e.g., linkages 236) hidden. The solid lines indicate a shape of the stabilizer 202 when it is in the raised condition (e.g., as shown in FIGS. 2-4). The stabilizer 202 has a star shape with four tip points 220 and four crook points 222. The tip points 220 are positioned at the radially outer ends of the triangular panels on the upper linear hinges 214 (relative to the center point 224 of the stabilizer). The crook points 222 are positioned at the radially outermost points of the lower linear hinges 216 relative to the center point 224. Each adjacent pair of the tip points 220 has a crook point 222 positioned on the lower linear hinge 216 located between the pair of adjacent tip points 220. In various embodiments, other star-shaped patterns can be implemented for the stabilizer 202. See, e.g., FIGS. 9 and 10.

As the stabilizer 202 is unfolded and depressed, the tip points 220 and crook points 222 can move in a radially outward direction to an unfolded position that has a perimeter shown by broken line 202*a*. The tip points 220 can move outward to expanded positions 220*a*, and the crook points 222 can move outward to expanded positions 222*a*. The length of each of the upper and lower linear hinges 214, 216 can be consistent in the raised condition and in the unfolded position, yet an angle between a star-arm of the stabilizer 202 and the base layer 204 can decrease from a first, larger angle 224 (see FIG. 4) to a second, smaller angle 224*a* (see FIG. 5). Accordingly, the tip points 220 and crook points 222 can slide away from the axis of motion Z as the center point 224 moves downward along the axis of motion Z.

In some embodiments, the stabilizer 202 can have tip points 220 that are fixed in place. For example, the tip points 220 can be pivotably affixed to the base layer 204. In this case, movement of the center point 224 downward does not induce radially outward movement of the tip points 220. As shown by the second broken line 202*b* in FIG. 6, the tip points 220 are stationary while the crook points 222*b* move outward. To facilitate this movement, the linear hinges 214, 216 can comprise an elastically deformable material. See FIG. 7 and its related descriptions herein.

Additionally, as shown in FIG. 6, when the stabilizer 202 is flat or viewed from above, upper linear hinges 214 can be positioned on a first upper folding axis 226 or on a second upper folding axis 228. These upper folding axes 226, 228 can be substantially perpendicular to each other and can be referred to as ridge folding axes since they are aligned with the upward-pointing ridges of the upper linear hinges 214 between adjacent triangular panels 212. Lower folding axes 230, 232 can be aligned with the lower linear hinges 216 and can be substantially perpendicular to each other as well. These axes 230, 232 can be referred to as groove folding axes since they are aligned with the upward-facing grooves of the lower linear hinges 216 between adjacent triangular panels 212 when the stabilizer 202 is in its three-dimensional raised condition. The upper and lower folding axes 226, 228, 230, 232 can all intersect at the center point 224 or on the axis of motion Z. The triangular panels 212 on each side of a folding axis can move or rotate relative to each other. When the stabilizer 202 is in its raised condition, a separate folding axis can extend along each of the linear hinges 214, 216, with each of the folding axes intersecting at the center point 224. Thus, the stabilizer 202 has multiple intersecting folding axes.

Figure 7:
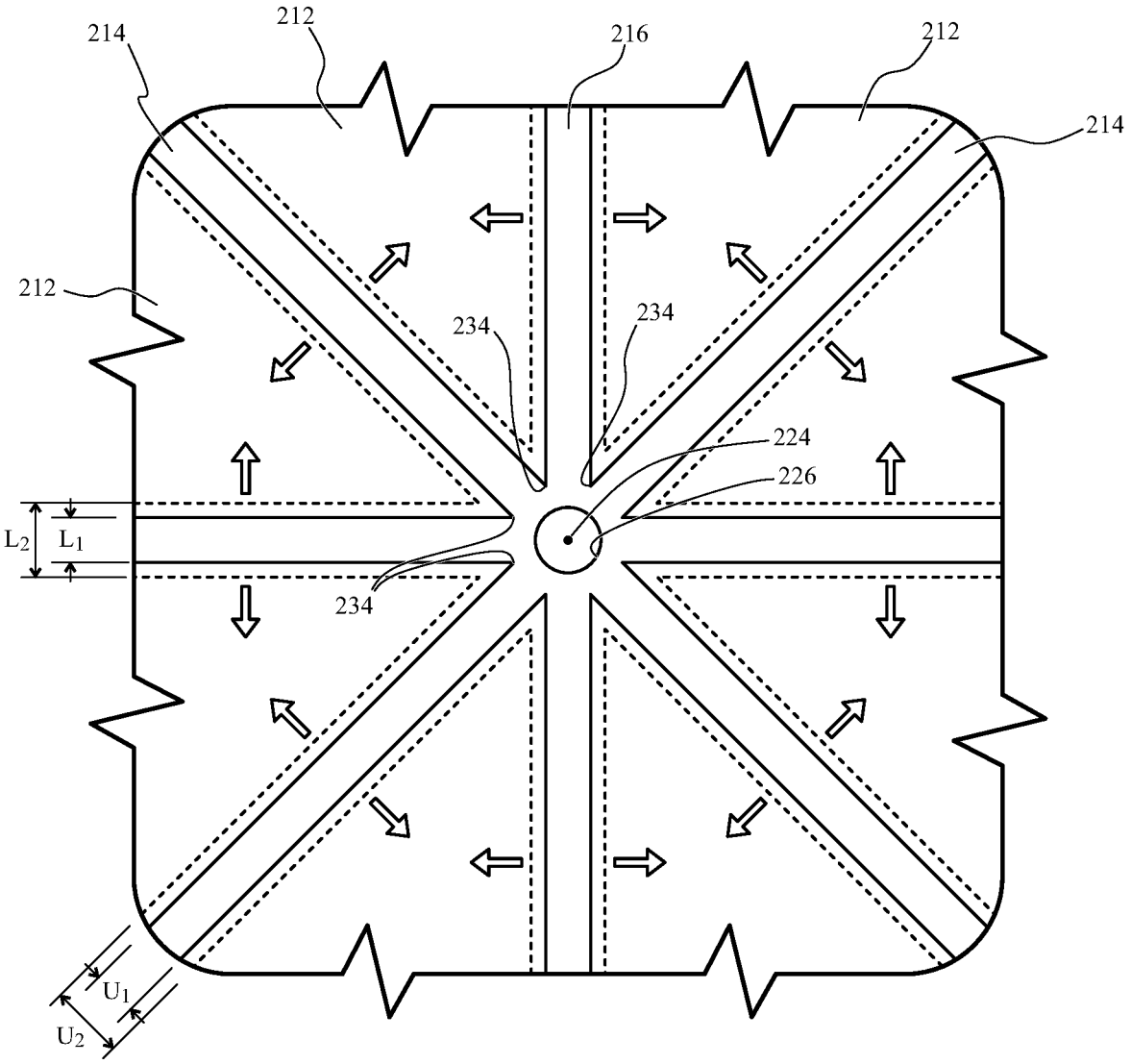
FIG. 7 is a detail top view of the stabilizer of FIG. 6.

FIG. 7 shows a detail top view of an embodiment of a stabilizer 202 as shown by box 7 in FIG. 6. An opening 225 can be formed in the stabilizer 202 and located about the center point 224 of the stabilizer 202. The opening 225 can provide stress relief for the linear hinges 214, 216 when they are stretched or compressed during use of the stabilizer 202. The linear hinges 214, 216 can each have a first lateral width $U_1$, $L_1$ when the stabilizer 202 is in a raised condition. The lateral widths $U_1$, $L_1$ can be equal or different. For example, the upper hinge lateral widths $U_1$ can be greater than the lower hinge lateral widths $L_1$. Such a configuration can allow the upper linear hinges 214 to be more flexible than the lower linear hinges 216. Accordingly, the flexibility of the hinges 214, 216 can be controlled at least in part by their lateral widths $U_1$, $L_1$.

The first lateral widths $U_1$, $L_1$ can correspond to a flattened condition of the stabilizer 202, and the second lateral widths $U_2$, $L_2$ can correspond to a raised condition of the stabilizer 202. Thus, the stabilizer 202 can be configured to expand, perhaps circumferentially, or compress the linear hinges 214, 216 relative to the center point 224 when flattening. As pressure is applied to the stabilizer 202 and the stabilizer 202 flattens, the lateral widths $U_1$, $L_1$ can change. In some embodiments, the lateral widths $U_1$, $L_1$ can increase to lateral widths $U_2$, $L_2$, as shown in FIG. 7.

The lateral widths can be elastically or resiliently expanded to the increased dimensions to accommodate the movement of the rigid triangular panels 212 since the edges 218 of the panels move through arc-shaped paths between their raised positions (shown in FIG. 4) and their relatively flattened positions (shown in FIG. 5). Elastic flexibility of the linear hinges 214, 216 can also be used in embodiments of the stabilizer 202 wherein the tip points 220 are fixed in place because pivoting rotation or movement of the triangular panels at the fixed tip points 220 can cause the inner ends of the triangular panels 212 (e.g., inner points 234 in FIG. 7) to move radially toward the center point 224. Elastic expansion or compression of the linear hinges 214, 216 can store energy in the stabilizer 202 and can thereby allow the stabilizer 202 to resiliently spring back or otherwise be biased toward the initial shape of the hinges 214, 216 when forces on the stabilizer 202 are released.

Figure 8:
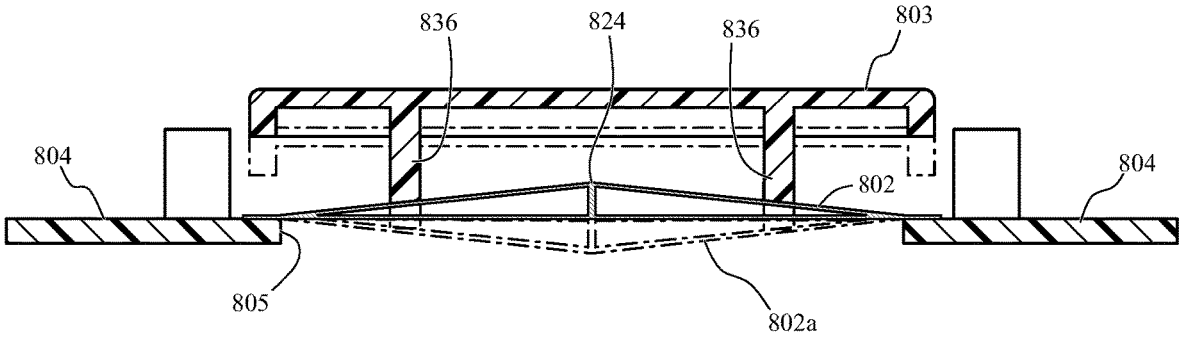
FIG. 8 is a diagrammatic side section view of a key assembly according to another embodiment in the present disclosure.

FIG. 8 is a diagrammatic side section view of another embodiment of a stabilizer 802 positioned under a keycap 803 and with a set of linkages 836 extending from the keycap 803 into contact with the upper surface of the stabilizer 802. In this embodiment, movement of the keycap 803 can cause the stabilizer 802 to flatten. A ratio of vertical movement of the keycap 803 relative to the top center point 824 of the stabilizer 802 can be uneven due to the top surfaces of the stabilizer 802 passing through arc-shaped paths in comparison to the linear path of the keycap 803. In other words, the ratio of keycap 803 movement to the movement of the top of the stabilizer 802 can be greater than or less than 1-to-1. The top point 824 of the stabilizer can move vertically more quickly than the vertical movement of the keycap 803. This uneven ratio configuration can also be used to amplify forces in the stabilizer. For example, movement of the keycap 803 can apply force to the top surface of the stabilizer 802 similar to applying force to a lever. The force applied by the keycap 803 can thereby be amplified at the center of the stabilizer 802. Accordingly, the stabilizer 802 can be used to amplify a downward force applied by a user. In one application of this feature, the stabilizer 802 can be used to compress a stiff spring or collapsible dome (e.g., 208) positioned under the stabilizer 802 that, without force amplification, would otherwise need to be less stiff to achieve a desired key feel. Additionally, the rate of flattening of the stabilizer 802 (as determined by the rate of movement of the center point 824) can change the vertical position or duration of a tactile feedback "bump" felt by the user when the keycap 803 is pressed, particularly when the stabilizer 802 is bistable and configured to invert when pressed.

As diagrammatically shown in section view in FIG. 8, a stabilizer 802 can be configured to invert in response to movement of the keycap 803. The stabilizer 802 can have similar construction to the stabilizer 202 of FIG. 7, and the linear hinges of the stabilizer 802 can comprise elastically resilient material. In such a case, downward pressure on the stabilizer 802 can compress and flatten it. Continued or increased downward pressure can then also invert its shape, wherein the upper and lower linear hinges (e.g., 214, 216) bend to an inverted orientation and the entire star shape points generally downward instead of upward, as indicated by stabilizer 802*a* shown in dashed lines. The stabilizer 802 can therefore be configured to have multiple stable states, with at least one state corresponding to a generally upward-pointing or convex upper surface (e.g., 802) and at least a second state corresponding to a generally concave upper surface or generally downward-pointing bottom surface (e.g., 802*a*). In one embodiment, in order to facilitate inversion of the stabilizer 802, the base layer 804 can include a through-hole or opening 805 centered below the stabilizer 802 and into which the stabilizer 802 (and potentially also the linkages 836) extends when it is in its inverted condition (corresponding to stabilizer 802*a*).

As a result, a key stabilizer 802 (or 202) can be bistable. A bistable stabilizer 802 can be used to provide tactile feedback similar to a collapsible dome, wherein the force required to initially deflect the stabilizer 802 increases to a peak tactile force (roughly corresponding to the force required to flatten the stabilizer 802 by stretching or bending the linear hinges). The force required to continue to deflect the stabilizer 802 then decreases relative to the peak tactile force since the stabilizer 802 starts to invert in the same direction as the movement of the keycap 803. Once the stabilizer has fully inverted, a "bottom-out" force is reached wherein the stabilizer 802*a* has deflected to a point that further deflection is resisted by the elasticity of the linear hinges, contact between adjacent triangular panels in the stabilizer 802, contact between the stabilizer 802 and a lower support layer (not shown), contact between the keycap 803 and a rigid surface (e.g., base layer 804), or another similar constraint. After deflection of the stabilizer 802, elasticity in the linear hinges can bias the stabilizer (and keycap 803) to return to the raised condition. In some embodiments, the bistable stabilizer 802 can be positioned above a resiliently compressible dome, spring, or other biasing member that supplements the biasing return force and assists in returning the stabilizer 802 to the raised condition after being deflected downward.

Figure 9:
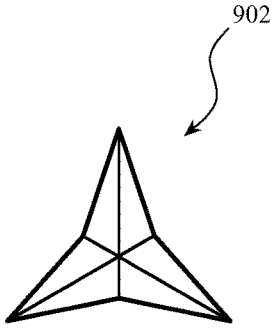
FIG. 9 is a top view of a stabilizer of another embodiment in the present disclosure.
Figure 10:
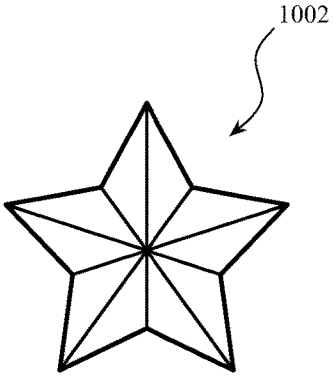
FIG. 10 is a top view of a stabilizer of another embodiment in the present disclosure.

FIGS. 9 and 10 illustrate alternative embodiments of star-shaped stabilizers 902, 1002. Stabilizer 902 shows a three-pointed star configuration, and stabilizer 1002 shows a five-pointed star configuration. As will be readily apparent in view of the present disclosure, two or more star points can be implemented to create the stabilizers of the present disclosure. In some embodiments, three or more star points can be included in the stabilizers. The number of star points can be selected in view of several factors, such as the type and number of connection linkages between the keycap and the stabilizer (described in further detail below), the desired height, size, and stiffness of the stabilizer (wherein increasing the number of star points increases the overall amount of bendable material and points of articulation in the stabilizer), and the fit and orientation of the stabilizer relative to other nearby stabilizers (particularly when multiple stabilizers are located on a common sheet or substrate material; see FIG. 22 and its related descriptions herein).

Referring again to FIGS. 3-5, a set of linkages 236 can connect the keycap 103 to the stabilizer 202. The linkages 236 can be attached to, embedded in, or integral with the bottom of the keycap 103 and can be attached to, embedded in, or integral with the stabilizer 202. The keycap 103 can thereby be connected to the stabilizer 202 via the linkages 236. In some embodiments, the keycap 103 can also contact a center (e.g., at or near the inner points 234) of the stabilizer 202, as shown in FIGS. 4-5. In some cases, the center of the bottom surface of the keycap 103 can be spaced away from the stabilizer 202, and movement of the keycap 103 can be transferred to the stabilizer 202 solely by the linkages 236. See FIG. 8.

When the stabilizer 202 moves upward from a flattened position to a folded position, the linkages 236 can push upward on the bottom surface of the keycap 103. When the keycap 103 moves downward, such as when a centrally-positioned force $F_1$ is applied to the keycap 103 (see FIG. 5), the linkages 236 can push downward on the top surface of the stabilizer 202. As the stabilizer 202 flattens, the connection points between the linkages 236 and the stabilizer 202 can move through an arc. Accordingly, as shown in FIG. 5, the linkages 236*e* can bend or laterally move along with the stabilizer 202 as it flattens. In other words, the lateral distance (e.g., in the X-direction) between the linkages 236*e* at their connection to the stabilizer 202 can increase as the stabilizer 202 flattens. The lateral distance between the linkages 236*e* at their connection to bottom surface of the keycap 103 can be constant as the stabilizer 202 flattens. In some embodiments, the linkages 236 can buckle or bend as the stabilizer 202 flattens.

When pressure on the top surface 238 of the keycap 103 is centered on the axis of motion Z, such as by force $F_1$, the linkages 236 around the stabilizer 202 can all deform in substantially the same manner, as indicated in FIG. 5. Additionally, the linkages 236 can be used to transfer force from one side of the axis of motion Z to another. In this manner, the linkages 236 can help keep the top surface 238 of the keycap 103 substantially horizontal when off-center pressure is applied to the keycap, such as by force $F_2$ in FIG. 5. Without the linkages 236, the off-center force $F_2$ can tilt the top surface 238 of the keycap 103, and in some cases the stabilizer 202 would not deflect downward enough to trigger a switch in the assembly 200.

In some embodiments, the linkages 236 can comprise a flexible material. The linkages 236 can therefore be bendable or buckle in at least one direction. The linkages 236 can include a leg that is elongated along a length dimension that is perpendicular to the direction of deflection of the linkage when the keycap 103 is pressed. For example, as shown in FIG. 3, the linkages 236*a*, 236*b* have a leg exhibiting an elongated width along the Y-axis and have a relatively thinner depth along the X-axis. As shown in FIG. 5, when those linkages 236 deflect, the relative thicknesses along the X and Y axes make portions of the linkages 236 bend more easily in a direction parallel to the X-axis. The elongated width along the Y-axis increases the stiffness of the linkages 236*a*, 236*b* perpendicular to the X-axis, so they resist bending in that direction. Linkages 236*c* and 236*d* are wider along the X-axis relative to their depths along the Y-axis, so they are more flexible and bendable in a direction parallel to the Y-axis relative to a direction parallel to the X-axis.

In this manner, the dimensions of the linkages 236 can be implemented to control the direction of deflection of the linkages when the keycap 103 is depressed. This characteristic of the linkages 236 can be used to limit rotation of the keycap 103 about the axis of motion (Z-axis) as the keycap 103 moves vertically. Thus, the keycap 103 can be less capable of turning into an orientation where the edges or bottom of the keycap 103 could come into contact with the web 206, opening 210, other nearby keycaps, or other surrounding components. This feature can also help preserve the desired alignment of the parts in the assembly for aesthetic and functional reasons.

The linkages 236 can prevent or reduce tilting of the top surface 238 by ensuring that the keycap 103 and the stabilizer 202 move together. For example, if force $F_2$ is applied to the keycap 103, the linkage 236*e* can bend or buckle as the stabilizer 202 moves downward on the left side of the axis of motion Z, and the linkage 236*e* can help flatten the stabilizer 202 on that side of the axis. As the star-point on the left side of FIG. 5 deflects, its connection to the other star-points (via the panels 212 and hinges 214, 216) can induce flattening of the other star-points as well, such as, for example, the right side of the stabilizer 202 in FIG. 5. As a result, flattening of the left side of the stabilizer 202 simultaneously also flattens the right side of the stabilizer 202. The induced flattening of the right side of the stabilizer 202 pulls the right side of the keycap 103 downward because it is connected to the linkage 236*e* even though the force $F_2$ is not applied on that side. Accordingly, a force or pressure applied on one side of the axis of motion (e.g., the central axis) of the stabilizer 202 can induce movement on an opposite side of the stabilizer 202. In other words, flattening one star-point of the stabilizer 202 causes flattening of all of the star-points.

In embodiments where the linkages 236 are affixed at their top ends to the keycap 103 and at their bottom ends to the stabilizer 202, flattening of a first side of the stabilizer 202 can pull down on a side of the keycap 103 that is positioned above a different side of the stabilizer 202, as explained above. In other embodiments, the linkages 236 can be affixed to only one of the keycap 103 or the stabilizer 202, such as the linkages 836 of FIG. 8 which are only affixed to the keycap 803. The bottom ends of the linkages 836 can contact the stabilizer 802 and can slide relative to the stabilizer 802. When the linkages are only affixed at one end, they can still help facilitate keeping the top surface of the keycap horizontal when an off-center downward force is applied to the keycap. In this case, one side of the stabilizer can flatten and thereby induce flattening of other sides/pointed segments of the stabilizer. Rather than the linkages pulling down on the keycap, however, the keycap rests on top of the stabilizer, and the linkages ensure that the keycap rests on portions of the stabilizer that are positioned at substantially the same vertical height relative to the base layer. A biasing force on the keycap (e.g., gravity, a tension spring on the bottom of the keycap 803, or a flexible layer across the top surface of the keycap 803 (e.g., a fabric layer across the keys and/or web)) can help keep the keycap substantially horizontal as it moves. Linkages that are affixed or otherwise connected to a keycap or stabilizer on only one end can be referred to as soft mounts or sliding linkages.

Figure 11:
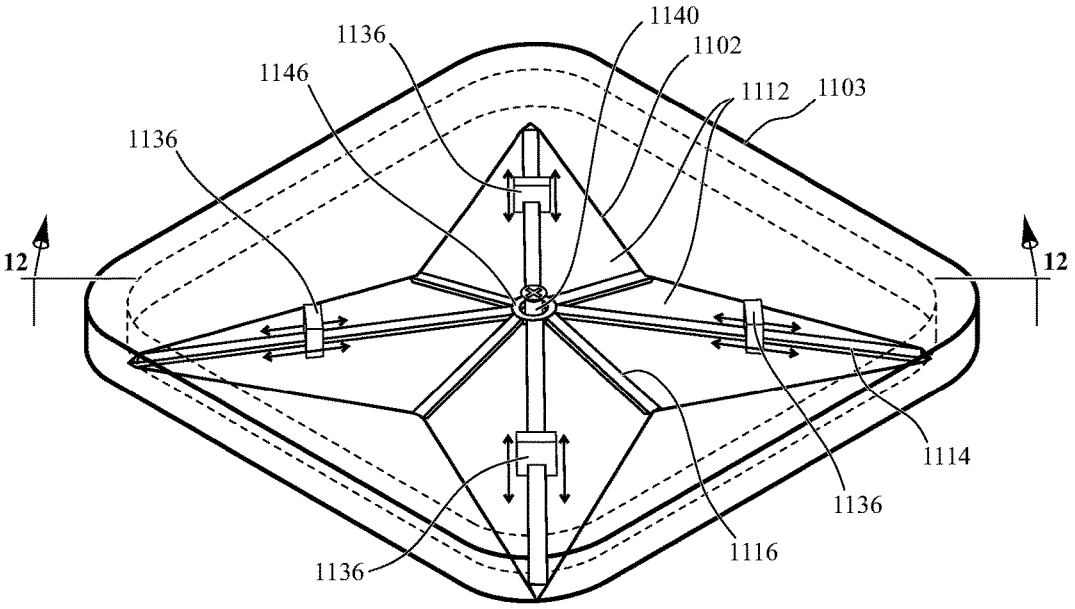
FIG. 11 is an isometric view of a keycap and stabilizer according to another embodiment of the present disclosure.
Figure 12:
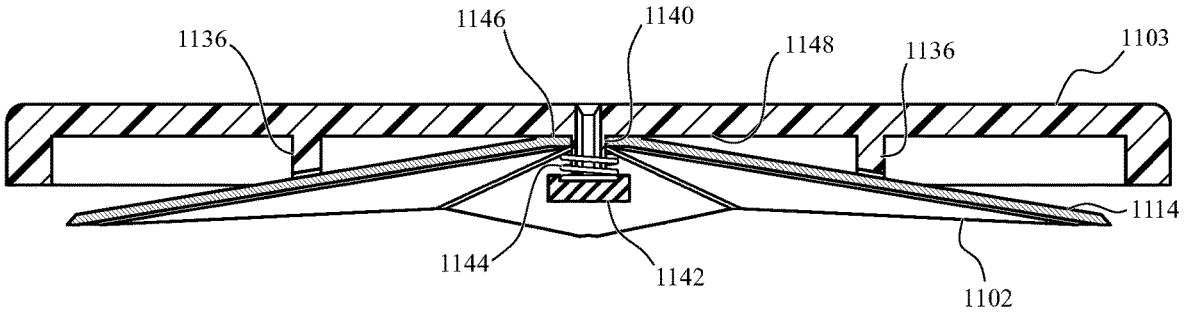
FIG. 12 is a side section view of the keycap and stabilizer of FIG. 11 as taken through section lines 12-12 in FIG. 11.

FIGS. 11 and 12 illustrate respective isometric and side section views of an additional embodiment of a stabilizer 1102 and keycap 1103. FIG. 12 is a section view taken through section lines 12-12 in FIG. 11. The keycap 1103 is shown transparent so that the stabilizer 1102 can be seen below it for explanation purposes. In various embodiments disclosed herein, the keycap 1103 and stabilizer 1102 (or other stabilizers disclosed herein) can be transparent or translucent to allow passage of light through the key assembly.

The stabilizer 1102 comprises a four-pointed star shape with a set of triangular panels 1112 connected to each other by upper and lower linear hinges 1114, 1116. As indicated by the arrows in FIG. 11, linkages 1136 extending from the keycap 1103 into contact with the stabilizer 1102 can slide along the surface of the stabilizer 1102 as the stabilizer 1102 folds or unfolds. The keycap 1103 can also include a central linkage 1140 extending through a central opening in the stabilizer 1102. The central linkage 1140 can have a lower end 1142 with a width greater than the width of the central opening of the stabilizer 1102. Accordingly, the lower end 1142 can interfere with removal of the keycap 1103 from the stabilizer 1102 and can help the keycap 1103 remain attached to the stabilizer 1102. In various embodiments, the lower end 1142 can be integrally formed with the central linkage 1140 or can be a broadening plug or nut attached to the end of the central linkage 1140.

A biasing member 1144 can be positioned around the central linkage 1140 and between the stabilizer 1102 and the lower end 1142. The biasing member 1144 can bias the stabilizer 1102 into a raised position by biasing the lower end 1142 away from the underside of the stabilizer 1102. Flattening the stabilizer 1102 can cause the center 1146 of the stabilizer 1102 to become spaced away from the bottom surface 1148 of the keycap 1103. As the stabilizer 1102 flattens, the biasing member 1144 can compress and store energy that is released to spread the lower end 1142 and the stabilizer 1102 upon a reduction of pressure on the keycap 1103. The biasing member 1144 can also be beneficial by reducing rattling or slop due to gaps between the keycap 1103 and stabilizer 1102 when the keyboard is assembled.

Figure 13:
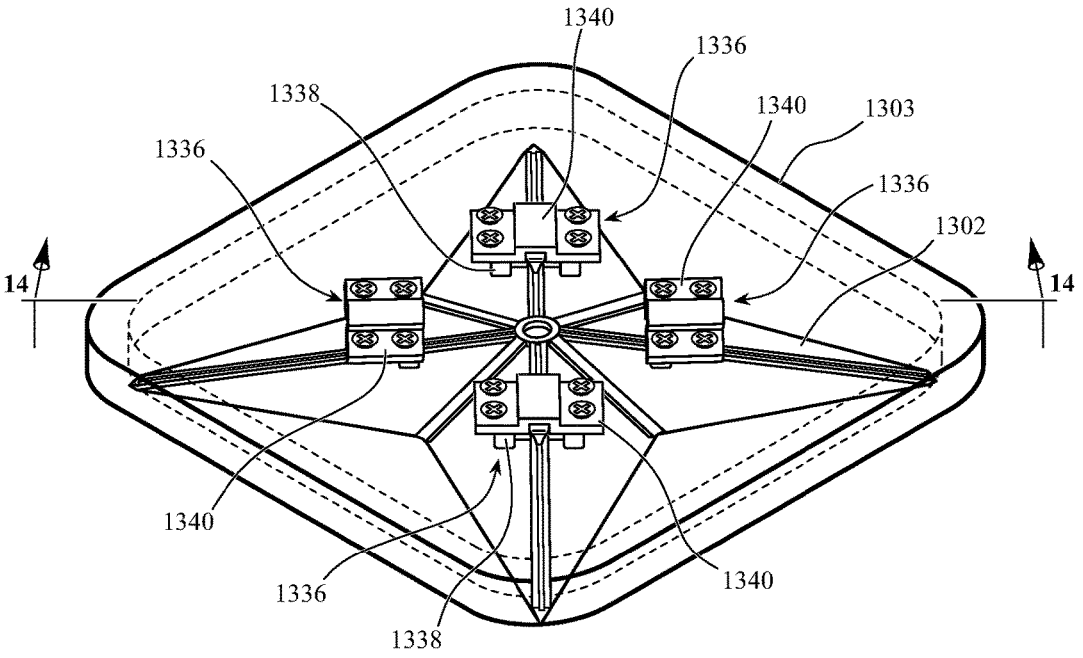
FIG. 13 is an isometric view of a keycap and stabilizer according to another embodiment of the present disclosure.
Figure 14:
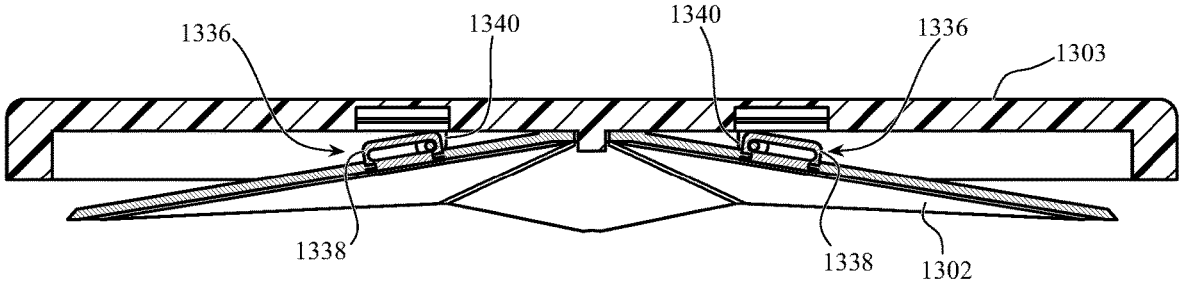
FIG. 14 is a side section view of the keycap and stabilizer of FIG. 13 as taken through section lines 14-14 in FIG. 13.

FIGS. 13 and 14 illustrate an additional embodiment of a stabilizer 1302 and keycap 1303. FIG. 13 is an isometric view with a transparent keycap 1303, and FIG. 14 is a side section view taken through section lines 14-14. Linkages 1336 can connect the stabilizer 1302 and keycap 1303 in an end-constrained sliding configuration (i.e., as an end-constrained sliding mounting). This configuration can also be referred to as a pin-in-slot configuration or a tracked slider configuration. The linkages 1336 can comprise a track or slot portion 1338 and a follower or pin portion 1340. In the pictured embodiment, the slot portion 1338 is attached to the stabilizer 1302 and the pin portion 1340 is attached to the keycap 1303. In other embodiments, the slot and pin portions can be attached in reverse or in a combination of pin and slot portions on the stabilizer and corresponding slot and pin portions on the keycap. As the stabilizer 1302 moves, it can pull or push the keycap 1303 at multiple points to help keep the top surface of the keycap 1303 substantially horizontal.

Pins of the pin portions 1340 can be positioned within and slide within slots of the slot portions 1338. The pins can move linearly along the length of the slots while the slots rotate relative to the pins as the stabilizer 1302 flattens or raises. Interference between the pins and the inner sidewalls of the slots can constrain movement of the keycap 1303 relative to the stabilizer 1302. For example, the keycap 1303 can be prevented from moving above a certain vertical distance away from a base layer due to mechanical interference between parts within the linkages 1336. Similarly, the stabilizer 1302 can be prevented from flattening past a certain point due to mechanical interference between the pins and slots in the linkages 1336.

Figure 15:
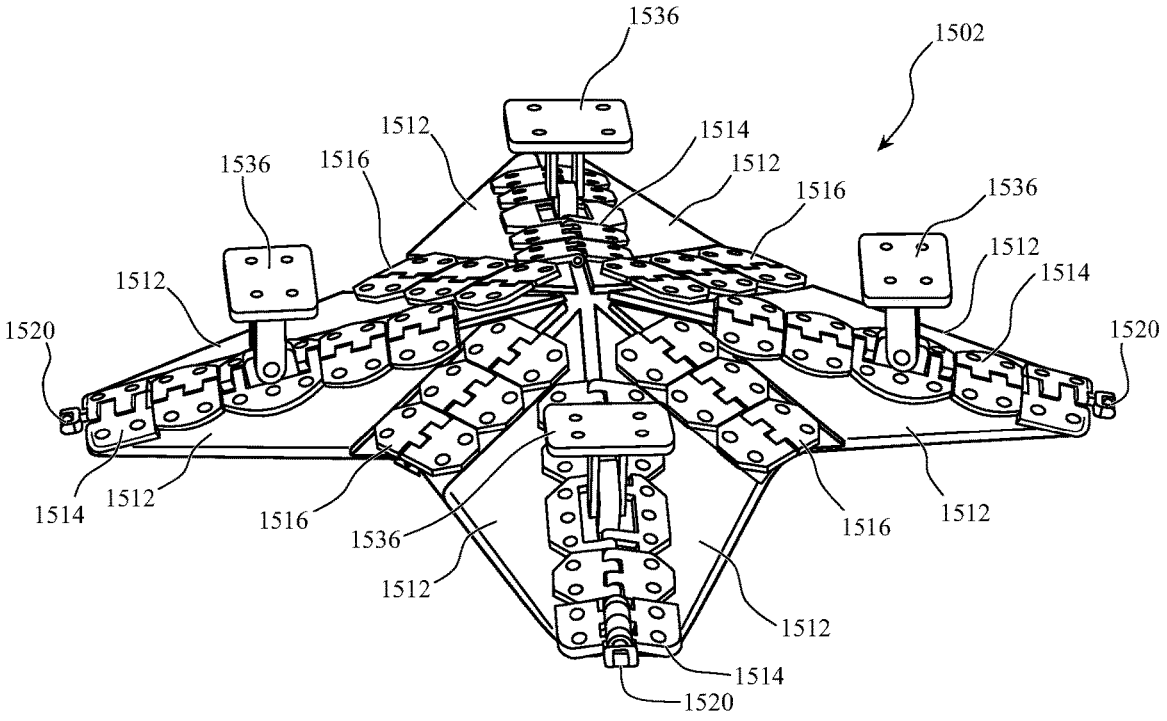
FIG. 15 is an isometric view of a stabilizer according to another embodiment of the present disclosure.

FIG. 15 shows an isometric view of a stabilizer 1502 according to another embodiment of the disclosure. The stabilizer 1502 can include a set of triangular panels 1512 connected to each other by upper and lower linear hinges 1514, 1516. The linear hinges shown in this embodiment can be referred to as door hinges or pin-in-barrel hinges. Each of the upper and lower linear hinges 1514, 1516 can comprise a subset of several smaller hinges arranged end-to-end. In some embodiments, a single, longer hinge can be used for each of the linear hinges 1514, 1516. The linear hinges 1514, 1516 can constrain the amount of bending for adjacent triangular panels 1512. For example, the linear hinges 1514, 1516 can be configured to prevent unfolding of adjacent panels 1512 beyond a predetermined maximum angle or folding below a predetermined minimum angle. The linear hinges 1514, 1516 can be configured without any elasticity, so the triangular panels 1512 are constrained to only pivot relative to each other. In this embodiment, the tip points 1520 can be movable (i.e., not pinned or fixed in place) to facilitate folding or unfolding movement of the stabilizer 1502. In some embodiments, a resilient member (e.g., an elastic band wrapped around the tip points 1520) can bias the tip points 1520 toward a central axis of motion of the stabilizer 1502.

The stabilizer 1502 can also comprise a set of linkages 1536 having upper ends attached to a keycap and lower ends attached to the stabilizer 1502. The lower ends can be pivotably and slidably connected to the stabilizer 1502 such as described above and thus can be moved along with the stabilizer 1502. The lower ends can be slidable along a folding axis of the stabilizer 1502. In some embodiments, the linear hinges 1514 can be made with rods along which the linkages 1536 can slide. The upper ends of the linkages 1536 can be fixed to or formed integral with the keycap.

Figure 16:
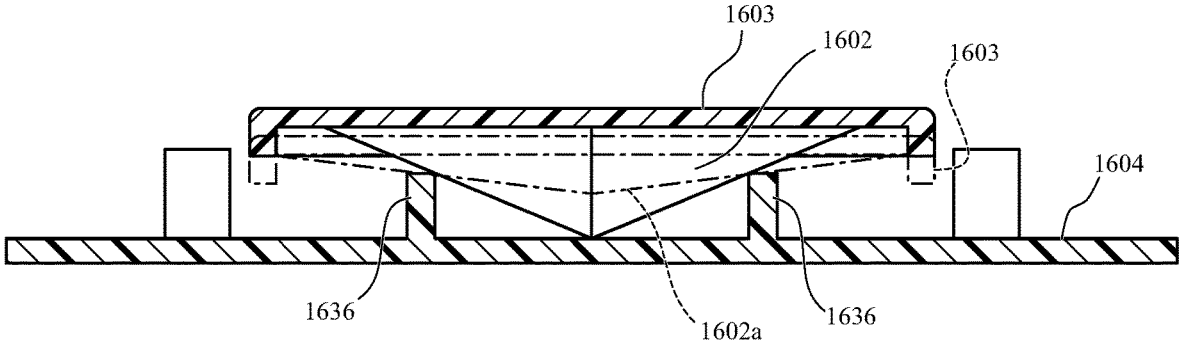
FIG. 16 is a diagrammatic side section view of a key assembly according to another embodiment in the present disclosure.

FIG. 16 illustrates a diagrammatic side section view of another configuration of a stabilizer 1602 and keycap 1603 over a base layer 1604. In this configuration, the raised orientation of the stabilizer 1602 is inverted relative to other embodiments shown herein. In other respects, the stabilizer 1602 can have a construction similar to, for example, stabilizer 202. The radially outer points of the star shape of the stabilizer 1602 can be positioned proximate the underside of the keycap 1603, and the linear hinges of the stabilizer 1602 can make a three-dimensional star shape that has a concave, recessed top surface and a convex, protruding bottom surface. The base layer 1604 can comprise a set of linkages 1636 configured to contact and deflect the stabilizer 1602 in response to downward movement of the keycap 1603. Thus, the outer portions of the stabilizer 1602 can be mounted to the keycap 1603 and the inner portions can be mounted to the base layer (via the linkages 1636 extending from the base layer 1604). This is opposite the embodiment of FIG. 4, for example, wherein the outer portions of the stabilizer 202 are mounted to the base layer 204 and a radially inner portion of the stabilizer 202 is mounted to the keycap.

The stabilizer 1602 can flatten under the keycap 1603 and on top of the linkages 1636. In this case, spacing between the base layer 1604 and the stabilizer 1602*a* can increase as the stabilizer flattens, and spacing between the stabilizer 1602*a* and the bottom of the keycap 1603 can simultaneously decrease. This inverted configuration can be beneficial when additional engagement between the keycap 1603 and stabilizer 1602 is desired. Other stabilizer embodiments disclosed herein can also be used in an inverted configuration.

Figure 17:
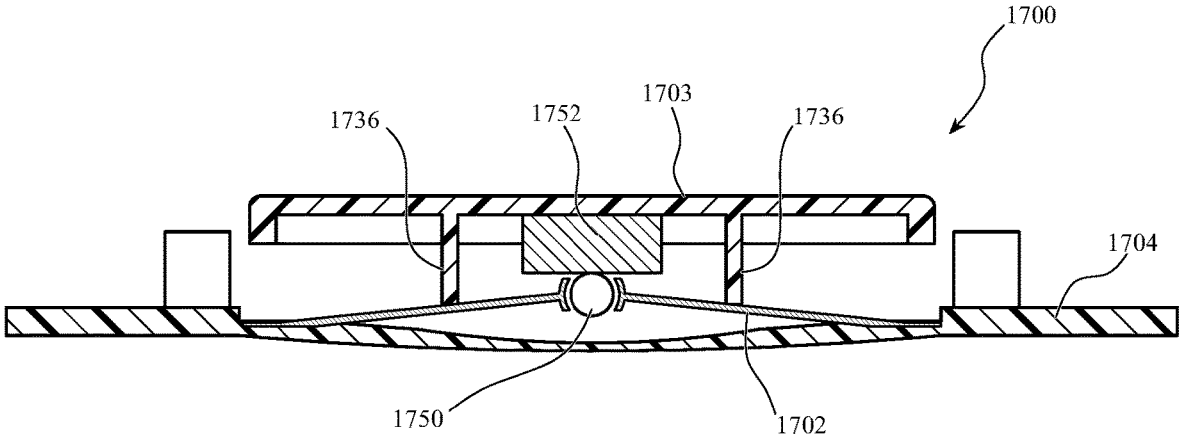
FIG. 17 is a diagrammatic side section view of a key assembly according to another embodiment in the present disclosure.
Figure 18:
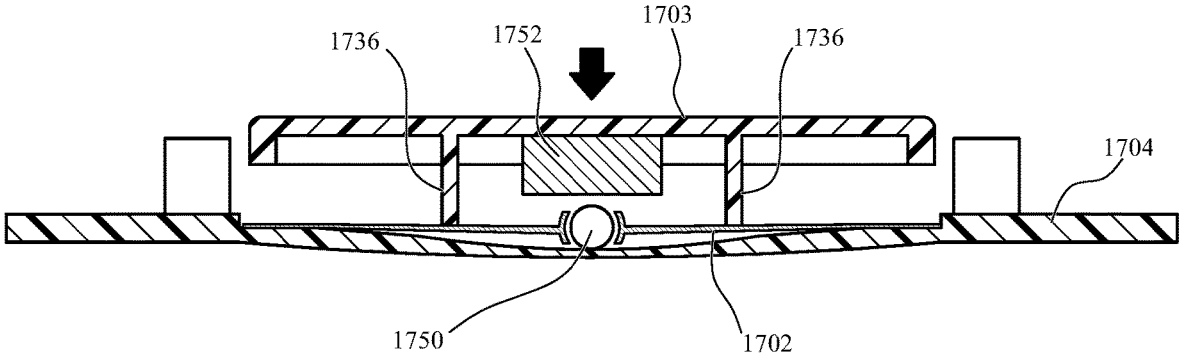
FIG. 18 is a diagrammatic side section view of the key assembly of FIG. 17 in a depressed condition.

FIGS. 17-18 are diagrammatic side section views of another embodiment of a key assembly 1700. FIG. 17 shows the keycap 1703, stabilizer 1702, and base layer 1704 in a raised condition, and FIG. 18 shows them in a depressed condition. The stabilizer 1702 can comprise a first magnetic element 1750 (e.g., a magnetic ball), and the keycap 1703 can comprise a second magnetic element 1752 (e.g., a ferrous plate). In another configuration, a ferrous ball can be used in place of the magnetic ball, and a magnetic plate can be used in place of the ferrous plate. Alternatively, two magnetic parts can be used.

The keycap 1703 can have linkages 1736 that contact the stabilizer 1702, similar to the linkages of other embodiments disclosed herein. The ball shape of the first magnetic element 1750 can allow the inner parts of the stabilizer to slide in contact with the ball shape in a manner similar to a ball-and-socket joint. The sliding can reduce friction between the stabilizer 1702 and the first magnetic element while maintaining the ball shape on the axis of motion of the stabilizer 1702.

In a raised condition, the linkages 1736 contact the stabilizer 1702, and the first magnetic element 1750 contacts the second magnetic element 1752. Magnetic attraction between the first and second magnetic elements 1750, 1752 can bias the stabilizer 1702 into a raised configuration, as shown in FIG. 17. Application of a downward force on the keycap 1703 can drive the linkages 1736 downward, thereby causing the stabilizer 1702 to flatten. The pressure of the linkages 1736 can overcome the magnetic attraction of the magnetic elements 1750, 1752 and cause them to separate from each other as the stabilizer 1702 flattens, as shown in FIG. 18. Overcoming the force of the magnetic attraction can provide a tactile peak force similar to that provided by buckling a compressible dome. As a result, the magnetic elements 1750, 1752 can provide a tactile bump in a force-displacement relationship of the key assembly 1700. The attraction between the magnetic elements 1750, 1752 can also be arranged to bias the stabilizer 1702 toward the raised condition such that releasing downward force on the keycap 1703 can cause the stabilizer to raise the keycap 1703 from the position shown in FIG. 18 to the position shown in FIG. 17.

Figure 19:
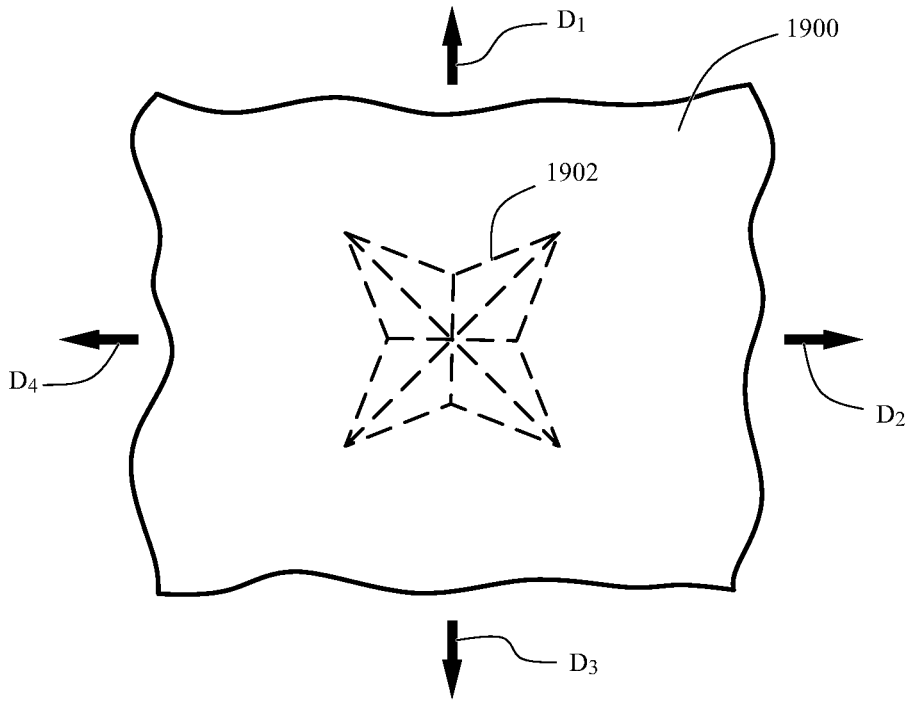
FIG. 19 is a top view of a sheet of material according to an embodiment of the present disclosure.
Figure 20:
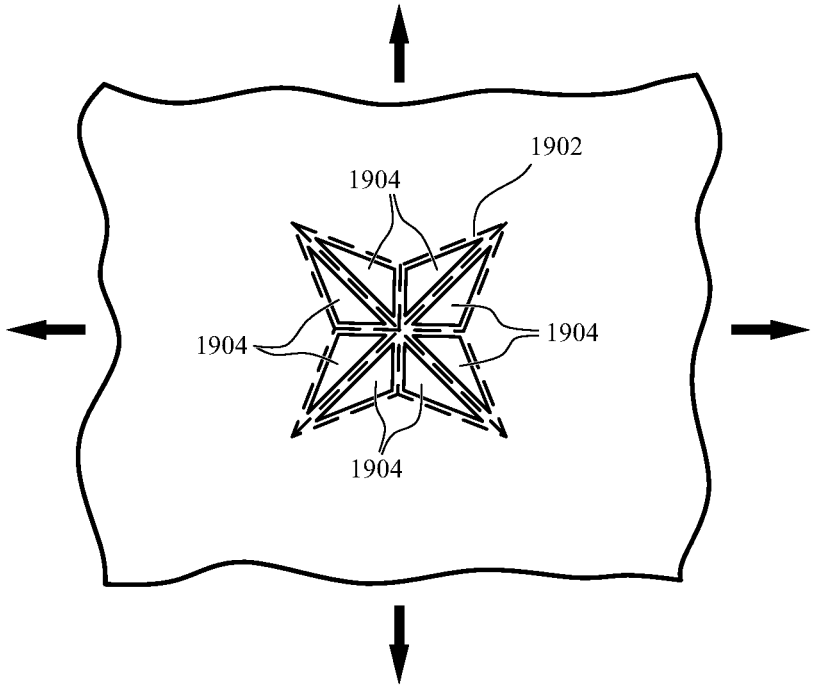
FIG. 20 is a top view of the sheet of material of FIG. 19 at another stage of work on the sheet of material.
Figure 21:
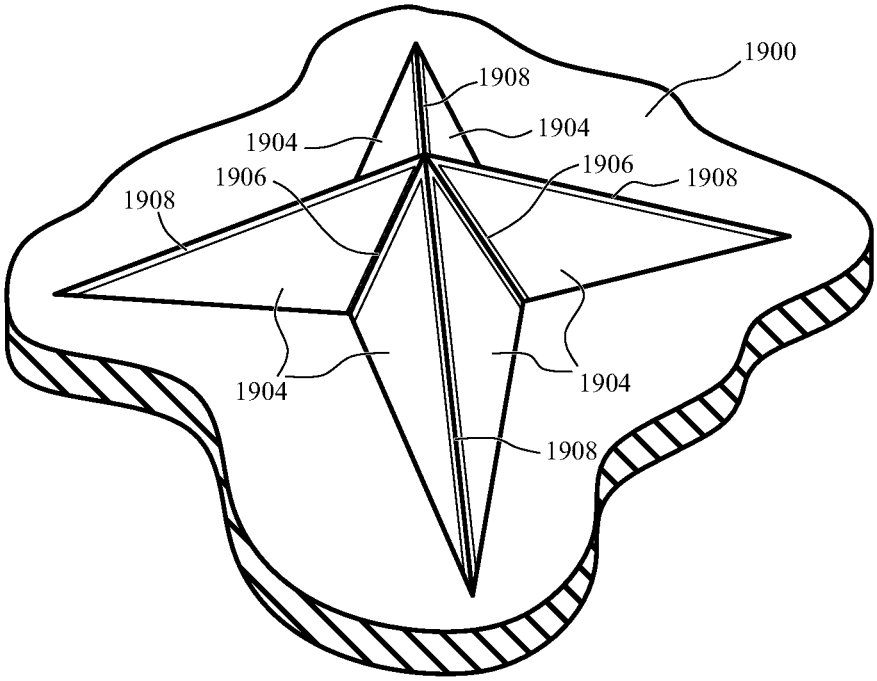
FIG. 21 is an isometric view of the sheet of material of FIG. 19 at another stage of work on the sheet of material.

FIGS. 19-21 show another embodiment of the present disclosure including method steps to manufacture stabilizers according to the present disclosure. FIG. 19 shows a top view of a sheet of flexible material 1900. The flexible material 1900 can be an elastic, resilient material that is substantially flat. The flexible material 1900 can be stretched in one or more directions, such as in lateral directions $D_1$, $D_2$, $D_3$, $D_4$. Accordingly, the flexible material 1900 can be placed in tension. A star-shaped space 1902 comprising a set of triangular sections on the flexible material 1900 can be isolated and prepared for construction of a stabilizer.

As shown in FIG. 20, while the flexible material 1900 is in tension, a set of triangular panels 1904 can be applied to the surface of, or otherwise formed in, the flexible material 1900 within the triangular sections of the star-shaped space 1902. In some embodiments, the triangular panels 1904 can be applied to the flexible material 1900 using a printing process, such as an additive 3D printing process (e.g., material extrusion, fused deposition modeling (FDM), vat polymerization, stereolithography (SLA), digital light processing (DLP), selective laser sintering (SLS), similar processes, or combinations thereof). In another example, entire triangular panels 1904 can be adhered or laminated to the flexible material 1900 within the star-shaped space 1902. The triangular panels 1904 can be configured to be more rigid and stiffer than the flexible material 1900. The triangular panels 1904 can be arranged with their edges spaced apart along at least two folding axes of the stabilizer.

After the triangular panels 1904 are applied or formed (and hardened if needed), the tension on the flexible material 1900 can be released. Releasing the tension can allow the portions of the flexible material between the triangular panels 1904 to contract. The triangular panels 1904 would not also contract, so the star-shaped space 1902 and triangular panels 1904 can be biased into the three-dimensional shape shown in the perspective view of FIG. 21. Portions of the star-shaped space 1902 can fold inward, resulting in lower linear hinges 1906, and portions can fold outward, resulting in upper linear hinges 1908. The linear hinge portions of the flexible material 1900 can be referred to as being preloaded or pretensioned due to the loading on the flexible material 1900 during the application of the triangular panels 1904.

In some embodiments, tension is not applied to the flexible material 1900. The flexible material 1900 can be a bendable material that does not significantly stretch under tension. In this case, the star-shaped space 1902 may not be biased into a three-dimensional shape due to a lack of preload on the flexible material. The star-shaped space 1902 can be manipulated into a raised condition by movement of the flexible material 1900 or by a force applied by another portion of the key assembly (e.g., a biasing member contacting the flexible material 1900).

The flexible material 1900 can be cut around an outer perimeter of the star-shaped space 1902 to generate a stabilizer isolated from the sheet of material. In another embodiment, the sheet of flexible material can be positioned in the keyboard below the keycaps.

Figure 22:
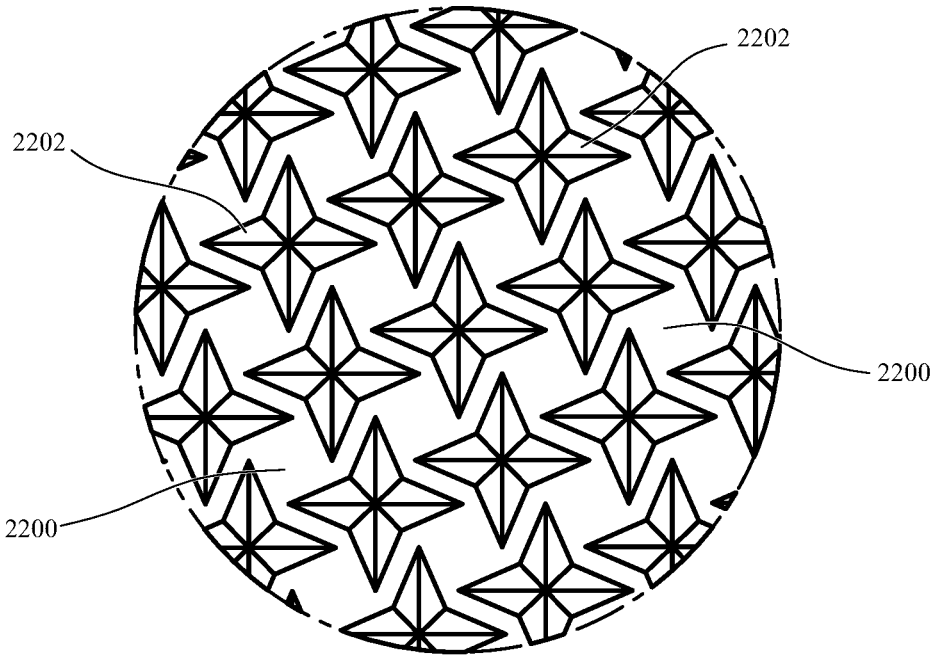
FIG. 22 is an isometric view of a sheet of material comprising as set of stabilizers.

FIG. 22 shows an isometric view of a sheet of flexible material 2200 on which a set of stabilizers 2202 are positioned. The perimeters of the stabilizers 2202 are all connected to each other by intervening spans of the flexible material 2200. In some embodiments, the stabilizers 2202 are distributed across the flexible material 2200 in a configuration corresponding to a keyboard layout, such as a QWERTY laptop keyboard layout, full-size keyboard layout, numpad layout, a custom keyboard layout, or another comparable layout. Thus, the sheet of flexible material 2200 can be positioned within a keyboard assembly to provide stabilization for multiple keycaps in the keyboard. Using a single sheet (or multiple sheets that each have multiple stabilizers 2202) instead of separate stabilizers for each keycap can simplify and reduce the costs of manufacturing the keyboard. A sheet of flexible material 2200 can also beneficially provide a barrier to debris or fluids that fall on the keyboard and can thereby limit the amount of that material that comes into contact with a base layer (e.g., 204), dome (e.g., 208), or other components below the flexible material 2200.

In some embodiments, the flexible material 2200 can comprise a set of openings positioned on the material between the outer perimeters of adjacent stabilizers 2202. The set of openings can change shape as nearby stabilizers change shape in order to help isolate movement of the stabilizers from each other. Thus, the openings can provide stress relief in the flexible material 2200 to limit undesired movement of a stabilizer as a nearby stabilizer moves. Thus, the movement of one keycap is less likely to cause movement of a different nearby keycap due to deformation of the openings.

In some embodiments, the sheet of material shown in FIG. 19 can be a substantially rigid material. For example, the sheet of material can be configured to be as rigid as the triangular panels 212 of the stabilizer. The rigid sheet of material can be worked on without applying tension to the sheet (e.g., in directions $D_1$-$D_4$). The star-shaped space 1902 on the rigid sheet of material can be defined in a portion of the sheet that will be made bendable or flexible. In some configurations, the lines of the star-shaped space 1902 can define areas on the rigid sheet of material that are thinned, reduced in thickness, perforated, or otherwise weakened to reduce their rigidity and to enhance their bendability. Bending the material along those lines can generate a star-shaped, three-dimensional stabilizer. As a result, the rigid sheet of material can comprise a stabilizer that is generated by selectively increasing the bendability of a sheet of rigid material along folding axes and then bending the material along the portions with increased bendability.

To the extent applicable to the present technology, gathering and use of data available from various sources can be used to improve the delivery to users of invitational content or any other content that may be of interest to them. The present disclosure contemplates that in some instances, this gathered data may include personal information data that uniquely identifies or can be used to contact or locate a specific person. Such personal information data can include demographic data, location-based data, telephone numbers, email addresses, TWITTER(R) ID's, home addresses, data or records relating to a user's health or level of fitness (e.g., vital signs measurements, medication information, exercise information), date of birth, or any other identifying or personal information.

The present disclosure recognizes that the use of such personal information data, in the present technology, can be used to the benefit of users. For example, the personal information data can be used to deliver targeted content that is of greater interest to the user. Accordingly, use of such personal information data enables users to calculated control of the delivered content. Further, other uses for personal information data that benefit the user are also contemplated by the present disclosure. For instance, health and fitness data may be used to provide insights into a user's general wellness, or may be used as positive feedback to individuals using technology to pursue wellness goals.

The present disclosure contemplates that the entities responsible for the collection, analysis, disclosure, transfer, storage, or other use of such personal information data will comply with well-established privacy policies and/or privacy practices. In particular, such entities should implement and consistently use privacy policies and practices that are generally recognized as meeting or exceeding industry or governmental requirements for maintaining personal information data private and secure. Such policies should be easily accessible by users, and should be updated as the collection and/or use of data changes. Personal information from users should be collected for legitimate and reasonable uses of the entity and not shared or sold outside of those legitimate uses. Further, such collection/sharing should occur after receiving the informed consent of the users. Additionally, such entities should consider taking any needed steps for safeguarding and securing access to such personal information data and ensuring that others with access to the personal information data adhere to their privacy policies and procedures. Further, such entities can subject themselves to evaluation by third parties to certify their adherence to widely accepted privacy policies and practices. In addition, policies and practices should be adapted for the particular types of personal information data being collected and/or accessed and adapted to applicable laws and standards, including jurisdiction-specific considerations. For instance, in the US, collection of or access to certain health data may be governed by federal and/or state laws, such as the Health Insurance Portability and Accountability Act (HIPAA); whereas health data in other countries may be subject to other regulations and policies and should be handled accordingly. Hence different privacy practices should be maintained for different personal data types in each country.

Despite the foregoing, the present disclosure also contemplates embodiments in which users selectively block the use of, or access to, personal information data. That is, the present disclosure contemplates that hardware and/or software elements can be provided to prevent or block access to such personal information data. For example, in the case of advertisement delivery services, the present technology can be configured to allow users to select to "opt in" or "opt out" of participation in the collection of personal information data during registration for services or anytime thereafter. In another example, users can select not to provide mood-associated data for targeted content delivery services. In yet another example, users can select to limit the length of time mood-associated data is maintained or entirely prohibit the development of a baseline mood profile. In addition to providing "opt in" and "opt out" options, the present disclosure contemplates providing notifications relating to the access or use of personal information. For instance, a user may be notified upon downloading an app that their personal information data will be accessed and then reminded again just before personal information data is accessed by the app.

Moreover, it is the intent of the present disclosure that personal information data should be managed and handled in a way to minimize risks of unintentional or unauthorized access or use. Risk can be minimized by limiting the collection of data and deleting data once it is no longer needed. In addition, and when applicable, including in certain health related applications, data de-identification can be used to protect a user's privacy. De-identification may be facilitated, when appropriate, by removing specific identifiers (e.g., date of birth, etc.), controlling the amount or specificity of data stored (e.g., collecting location data a city level rather than at an address level), controlling how data is stored (e.g., aggregating data across users), and/or other methods.

Therefore, although the present disclosure broadly covers use of personal information data to implement one or more various disclosed embodiments, the present disclosure also contemplates that the various embodiments can also be implemented without the need for accessing such personal information data. That is, the various embodiments of the present technology are not rendered inoperable due to the lack of all or a portion of such personal information data. For example, content can be selected and delivered to users by inferring preferences based on non-personal information data or a bare minimum amount of personal information, such as the content being requested by the device associated with a user, other non-personal information available to the content delivery services, or publicly available information.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

What is claimed is:

1. A keyboard, comprising:

a set of keycaps;

a feature plate positioned under the set of keycaps; and a set of foldable structures positioned under the set of keycaps;

wherein a foldable structure of the set of foldable structures comprises at least two intersecting folding axes and is movable between a raised position and a collapsed position in response to movement of a keycap of the set of keycaps;

wherein the foldable structure is configured to bend along the at least two intersecting folding axes while moving between the raised position and the collapsed position; and wherein the at least two intersecting folding axes include a first axis and a second axis, the foldable structure forming an upward-pointing ridge at the first axis and forming a downward-pointing ridge at the second axis.

2. The keyboard of claim 1, wherein the foldable structure of the set of foldable structures is configured to unfold along the at least two intersecting folding axes while moving from the raised position to the collapsed position.

3. The keyboard of claim 1, wherein the set of foldable structures are interconnected to each other across a layer of material.

4. The keyboard of claim 1, wherein the foldable structure comprises a sheet of material with a reduced thickness along one of the at least two intersecting folding axes.

5. The keyboard of claim 1, wherein the foldable structure is biased to the raised position by material positioned along the at least two intersecting folding axes.

6. The keyboard of claim 1, wherein the at least two intersecting folding axes intersect outer points of the foldable structure, the outer points being configured to translate relative to a center point of the foldable structure upon movement of the foldable structure between the raised position and the collapsed position.

7. A keyboard, comprising:

a set of keycaps;

a feature plate positioned under the set of keycaps;

a set of foldable structures positioned under the set of keycaps, wherein a foldable structure of the set of foldable structures comprises at least two perpendicularly intersecting folding axes and is movable along a central axis of motion between a raised position and a collapsed position in response to movement of a keycap of the set of keycaps;

wherein the foldable structure is configured to bend along the at least two perpendicularly intersecting folding axes while moving between the raised position and the collapsed position; and wherein the at least two intersecting folding axes intersect at least two outer points on the foldable structure, the at least two outer points being configured to laterally translate away from the central axis of motion in response to movement of the foldable structure from the raised position to the collapsed position.

8. The keyboard of claim 7, wherein the at least two outer points are positioned on pointed tips of the foldable structure.

9. The keyboard of claim 7, wherein the foldable structure includes at least one folding axis intersecting the at least two perpendicularly intersecting folding axes, wherein at least one crook point is positioned on the at least one folding axis, the at least one crook point being configured to laterally translate away from the central axis of motion in response to movement of the foldable structure from the raised position to the collapsed position.

10. The keyboard of claim 7, wherein the foldable structure forms a three-dimensional star shape.

11. The keyboard of claim 7, wherein the central axis of motion perpendicularly intersects the feature plate.

12. A keyboard, comprising:

a set of keycaps;

a feature plate positioned under the set of keycaps; and a set of foldable structures positioned under the set of keycaps;

wherein a foldable structure of the set of foldable structures comprises at least two intersecting folding axes and is movable between a raised position and a collapsed position in response to movement of a keycap of the set of keycaps;

wherein a set of outer points of the foldable structure are configured to translate relative to an intersection point of the at least two intersecting folding axes as the foldable structure moves between the raised position and the collapsed position.

13. The keyboard of claim 12, wherein the set of outer points are configured to laterally translate relative to the intersection point as the foldable structure moves between the raised position and the collapsed position.

14. The keyboard of claim 13, wherein the set of outer points are configured to laterally translate away from the intersection point as the foldable structure moves between the raised position and the collapsed position.

15. The keyboard of claim 12, wherein the foldable structure flattens as it moves between the raised position and the collapsed position.

16. The keyboard of claim 12, wherein the foldable structure includes resiliently bendable material along the at least two intersecting folding axes.

17. The keyboard of claim 12, wherein the foldable structure includes triangular panels having tip points, and wherein the set of outer points and the intersection point are positioned at the tip points of the triangular panels.

18. The keyboard of claim 12, wherein the set of outer points includes at least two outer points positioned on one of the at least two intersecting folding axes opposite each other relative to the intersection point.

19. The keyboard of claim 12, wherein the foldable structure is configured to bend along the at least two intersecting folding axes while moving between the raised position and the collapsed position.

20. The keyboard of claim 12, wherein the foldable structure includes a rigid material attached to a relatively resilient material between the at least two intersecting folding axes.

* * * * *